US005982275A

United States Patent [19]

Kosich

[11] Patent Number: 5,982,275

[45] Date of Patent: Nov. 9, 1999

[54] SYNCHRONIZED VIDEO/AUDIO ALARM SYSTEM

[75] Inventor: Joseph Kosich, South Toms River, N.J.

[73] Assignee: Wheelock, Inc., Long Branch, N.J.

[ * ] Notice: This patent is subject to a terminal disclaimer.

[21] Appl. No.: 09/074,328

[22] Filed: May 7, 1998

Related U.S. Application Data

[60] Continuation of application No. 08/807,063, Feb. 27, 1997, Pat. No. 5,751,210, which is a division of application No. 08/407,282, Mar. 20, 1995, Pat. No. 5,608,375.

[51] Int. Cl.[6] ..... G08B 25/00

[52] U.S. Cl. ..... 340/293; 340/331; 315/200 A

[58] Field of Search ..... 340/293, 326, 340/286.05, 331, 518; 315/241 S, 200 A

[56] References Cited

U.S. PATENT DOCUMENTS

| | | | |
|---|---|---|---|
| 3,488,558 | 1/1970 | Grafton | 315/312 |
| 3,881,130 | 4/1975 | Stiller | 315/230 |
| 3,969,720 | 7/1976 | Nishino | 340/815.69 |
| 3,973,168 | 8/1976 | Kearsley | 315/232 |
| 4,068,149 | 1/1978 | Wuchnich | 315/200 A |
| 4,101,880 | 7/1978 | Haus | 340/326 |
| 4,162,489 | 7/1979 | Thilo et al. | 340/518 |
| 4,216,413 | 8/1980 | Plas | 315/323 |
| 4,389,632 | 6/1983 | Seidler | 340/985 |
| 4,449,073 | 5/1984 | Mongoven et al. | 315/130 |
| 4,471,232 | 9/1984 | Peddie et al. | 307/35 |
| 4,472,714 | 9/1984 | Johnson | 340/916 |
| 4,881,058 | 11/1989 | Berry | 340/326 |
| 4,899,131 | 2/1990 | Wilk et al. | 340/518 |
| 4,924,149 | 5/1990 | Nishida et al. | 315/241 P |
| 4,952,906 | 8/1990 | Buyak et al. | 340/331 |
| 4,967,177 | 10/1990 | Nguyen | 340/331 |
| 5,121,033 | 6/1992 | Kosich | 315/241 R |
| 5,128,591 | 7/1992 | Bocan | 315/241 F |
| 5,342,069 | 8/1994 | Kosich et al. | 279/16 |
| 5,400,009 | 3/1995 | Kosich et al. | 340/331 |
| 5,559,492 | 9/1996 | Stewart et al. | 340/331 |
| 5,598,139 | 1/1997 | Karim | 340/286.11 |
| 5,608,375 | 3/1997 | Kosich | 340/293 |
| 5,659,287 | 8/1997 | Donati et al. | 340/331 |
| 5,751,210 | 5/1998 | Kosich | 340/293 |

FOREIGN PATENT DOCUMENTS

| | | |
|---|---|---|
| 0102229 | 3/1984 | European Pat. Off. . |
| 2031200 | 4/1980 | United Kingdom . |
| 2103404 | 2/1983 | United Kingdom . |
| 2211329 | 6/1989 | United Kingdom . |

OTHER PUBLICATIONS

Wheelock Inc. Catalog, Series 30 Horns & Series 7000 Strobe Horns, 1992.

Wheelock Inc., Product Brochure, MT Series, 1993.

*Primary Examiner*—Daniel J. Wu
*Assistant Examiner*—John Tweel, Jr.
*Attorney, Agent, or Firm*—Thomason, Moser and Patterson

[57] ABSTRACT

An audio/visual alarm system which includes multiple microprocessor-controlled alarm units connected in a common loop to a fire alarm control panel and an interface control circuit. The interface control circuit causes brief interruptions in power to the alarm units which synchronize operation of the alarm units and which can also be used as alarm control signals. The interface control circuit allows for control of both audio and visual alarms using only the single common loop connection between alarm units.

73 Claims, 23 Drawing Sheets

SYNCHRONIZED VIDEO/AUDIO ALARM SYSTEM

This is a continuation of application Ser. No. 08/807,063 filed on Feb. 27, 1997, now U.S. Pat. No. 5,751,210, which is a divisional of application Ser. No. 08/407,282, filed on Mar. 20, 1995, now U.S. Pat. No. 5,608,375.

BACKGROUND OF THE INVENTION

This invention relates to circuits for electronic alarm systems such as are used to provide visual and audio warning in electronic fire alarm devices and other emergency warning devices and, more particularly, to a control circuit which enables the system to provide both a visual and an audio alarm signal, including a silence feature, while using only one signal wire loop.

Strobe lights and/or audio horns are used to provide warning of potential hazards or to draw attention to an event or activity. An important field of use for these signalling devices is in electronic fire alarm systems. Strobe alarm circuits typically include a flashtube and a trigger circuit for initiating firing of the flashtube, with energy for the flash typically supplied from a capacitor connected in shunt with the flashtube. In some known systems, the flash occurs when the voltage across the flash unit (i.e., the flashtube and associated trigger circuit) exceeds the threshold voltage required to actuate the trigger circuit, and in others the flash is triggered by a timing circuit. After the flashtube is triggered, it becomes conductive and rapidly discharges the stored energy from the shunt capacitor until the voltage across the flashtube has decreased to a value at which the flashtube is extinguished and becomes non-conductive.

In a typical alarm system, a loop of several flash units is connected to a fire alarm control panel which includes a power supply for supplying power to all flash units in the loop when an alarm condition is present. Each unit typically fires independently of the others at a rate determined by its respective charging and triggering circuits. Underwriters Laboratories specifications require the flash rate of such visual signalling devices to be between 20 and 120 flashes per minute.

In addition to having a strobe alarm as described above, it may also be desirable to have an audio alarm signal to provide an additional means for alerting persons who may be in danger. In such systems, a "silence" feature is often available whereby, after a period of time has elapsed from the initial alarm, the audio signal may be silenced either automatically or manually. Heretofore, in a system where alarm units having both a visual alarm signal and an audio alarm signal have been implemented, two control loops, one for video and one for audio, have been required between the fire alarm control panel and the series of alarm units.

In a system as described above, the supply voltage may be 12 volts or 20–31 volts, and may be either D.C. supplied by a battery or a full-wave rectified voltage. Underwriters Laboratories specifications require that operation of the device must continue when the supply voltage drops to as much as 80% of nominal value and also when it rises to 110% of nominal value. However, when the voltage source is at 80% of nominal value, the strobe may lose some intensity which could prove crucial during a fire emergency.

It is a primary object of the present invention to provide a control circuit which will enable an alarm system to provide both audio and visual synchronized alarm signals using only a single control signal wire loop between the alarm units, while allowing for the capability of silencing the audio alarm.

It is yet another object of the present invention to provide the ability to lower the flash frequency when a low input voltage is detected, thereby ensuring a proper flash brightness.

It is another object of the present invention to provide an alarm interface circuit which will enable an existing alarm system to sound a Code 3 alarm whether or not the existing alarm system is already equipped with Code 3 capability.

It is another object of the present invention to provide a circuit having these properties and which will also work with: (a) both D.C. and full-wave rectified supplies; (b) all fire alarm control panels; and (c) mixed alarm units (i.e., 110 candela and 15 candela with and without audio signals).

SUMMARY OF THE INVENTION

In accordance with the present invention, an alarm system is provided which includes a control circuit that allows multiple audio/visual alarm circuits, connected together by a single two-wire control loop, to be synchronously activated when an alarm condition is present. The control circuit also allows for other alarm control functions, such as the deactivation of the audio alarm, to be carried out using only the single control loop. The control circuit is able to provide these functions by interrupting power to the alarm units for approximately 10 to 30 milliseconds at a time. Preferably, each alarm unit is equipped with a microcontroller which is programmed to interpret the brief power interrupt, or "drop out", as either a synchronization signal or a function control signal, depending on the timing of the drop out. The microcontroller can also be programmed to interpret different sequences of drop outs as control signals for other functions such as reactivation of the audio alarm.

The alarm unit is capable of detecting a low input voltage. When the detected voltage drops below a predetermined threshold, the alarm unit will lower the frequency of the visual alarm signal, preferably a strobe, to ensure that the strobe flashtube receives enough energy to flash at an adequate brightness.

The alarm unit is also capable of functioning independently of any synchronization signal from the control circuit. In the event a synchronization signal is not received, an internal timer will cause the flashtube to flash at a predetermined rate.

BRIEF DESCRIPTION OF THE DRAWINGS

Other objects, features and advantages of the invention will become apparent, and its construction and operations better understood, from the following detailed description when read in conjunction with the accompanying drawings, in which.

DESCRIPTION OF THE PREFERRED EMBODIMENT

Figure 1:
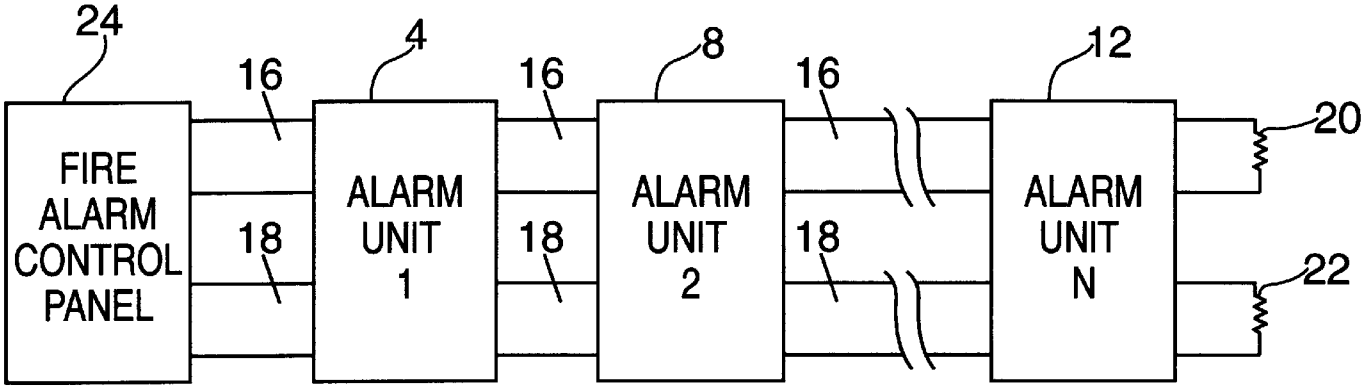
FIG. 1 (PRIOR ART)
FIG. 1 is a block diagram of a conventional prior art alarm system which provides for both visual and audio alarm signals.

In the conventional prior art alarm system shown in FIG. 1, which provides for both visual and audio alarm signals, multiple alarm units 4, 8 and 12, numbered 1 through N, are connected by two common loops 16, 18 having the usual end of the line resistors 20, 22, respectively. The alarm units have both audio and visual signalling capabilities. The first control loop 16 handles visual control signals being output from the fire alarm control panel 24 to the alarm units, and the second control loop 18 handles audio control signals being output from the fire alarm control panel 24 to the alarm units.

Figure 2:
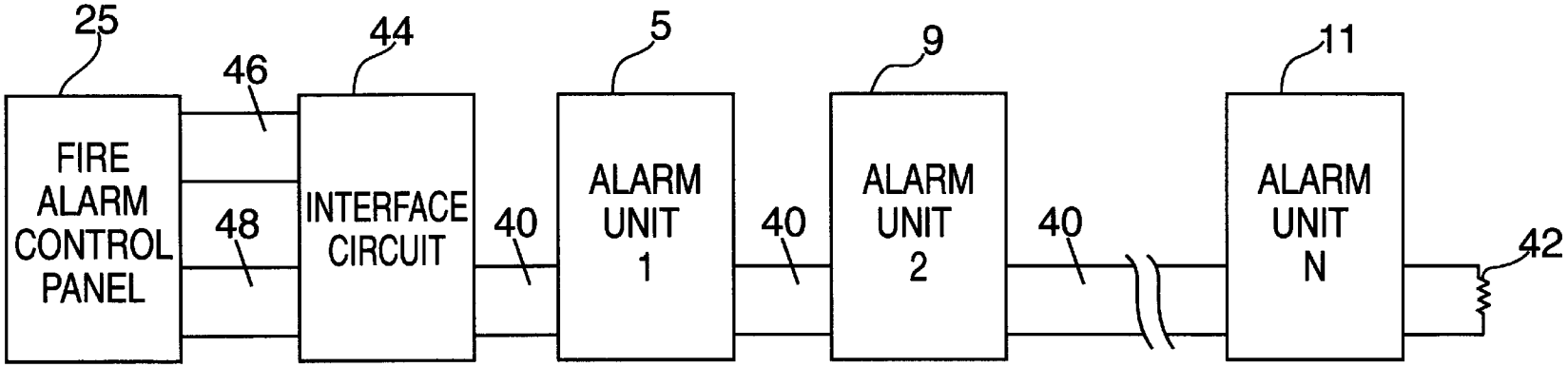
FIG. 2 is a block diagram of one embodiment of an alarm system of the present invention.

FIG. 2 is a block diagram of an embodiment of the alarm system of the present invention. By contrast to FIG. 1, multiple alarm circuits 5, 9 and 11, numbered 1 to N, are connected in a single control loop 40 with the usual end of the line resistor 42. In accordance with the invention, all units are caused to flash and sound synchronously using an interface control circuit 44 and the single control loop 40. The interface control circuit 44 is connected to the fire alarm control panel 25 via a primary input loop 46 and a secondary input loop 48. The alarm control panel 25 and the interface control circuit 44 can either be two separate devices or built into one unit.

The interface control circuit 44 provides the capability of silencing the audio alarms by outputting a signal to the alarm circuits 1 through N on the common loop 40 when a "silence " control signal is received from the fire alarm control panel 24 via the secondary input loop 48. According to the present invention, a single power interruption or "drop out", of approximately 10 to 30 msec in duration, is used as the synchronization, or "sync", pulse to keep the alarm units in sync with one another. A "silence" control signal is communicated to each of the alarm circuits by a second "drop out" in very close proximity to the sync pulse. As will be discussed in greater detail hereinbelow, it is possible to use the "drop outs" to signal any one of a number of functions to the alarm units, "silence" being just one.

There are an infinite number of possible audio sounds and signalling schemes which may be employed in an alarm system. Actual or simulated bells, horns, chimes and slow whoops, as well as prerecorded voice messages, can all be used as audio alarm signals. One audio signalling scheme gaining popularity is the evacuation signal found in National Fire Protection Agency 72. The signal is also known as Code 3. A Code 3 signal consists of three half-second horn blasts separated by half-second intervals of silence followed by one and one-half seconds of silence. Some alarm systems currently in use are equipped with Code 3 capability. For such systems, the present invention may be implemented using the secondary input loop 48 to transmit a Code 3 signal from the existing fire alarm control panel 24 to the interface control circuit 44 which will, in turn, send out a Code 3 signal to the alarm units. If the fire alarm system is one which is not equipped with Code 3 capability, the interface control circuit 44 can provide the signal itself. For purposes of illustration, but not limitation, the Code 3 signal will be discussed hereinbelow as the signalling scheme of the present invention.

Turning now to the visual alarm, for purposes of illustration, the strobe flashrate discussed herein is approximately 1.02 Hz under normal conditions. As will be explained in detail later, at an input voltage below the product specifications, the flashrate may be lowered to 0.5 Hz. Underwriters Laboratories permits a flashrate as low as 0.33 Hz.

Figure 3:
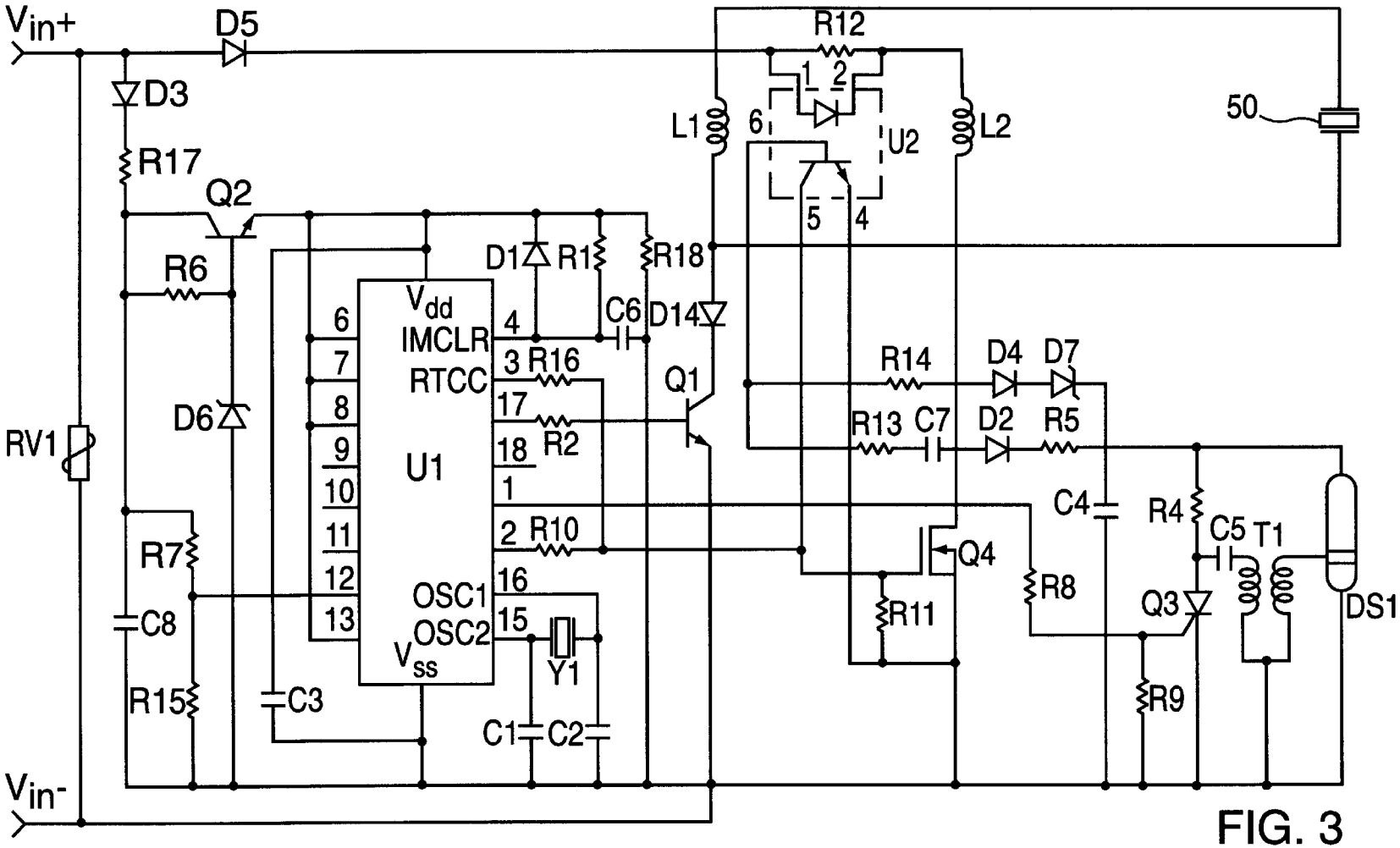
FIG. 3 is a circuit diagram of one embodiment of an alarm unit employed in the present invention.

FIG. 3 is a circuit diagram of one embodiment of each of the alarm units 5, 9 and 11. The unit depicted is a microprocessor-controlled audio/visual alarm unit which serves to demonstrate the full range of features available in the present invention. One skilled in the art will appreciate that an alarm unit with only visual or only audio capabilities may also be integrated into the system where desired. Each unit is energized from a D.C. power source embodied in the control panel 25. Metal Oxide Varistor RV1 is connected across the D.C. input to protect against transients on the input. A voltage regulator circuit provides the necessary voltage drop to power the microcontroller U1. Resistors R6 and R17 are connected in series between the cathode of diode D3 and the base electrode of switch Q2, which in this case is a transistor, and also to the cathode of Zener diode D6 which provides 5.00 volts ±5% volts to the microcontroller U1 across terminals $V_{dd}$ and $V_{ss}$. A capacitor C3 connected across the $V_{dd}$ and $V_{ss}$ terminals of U1 acts as a filter and will hold the voltage across U1 during the power drop outs which are used in the system as control signals.

A reset circuit for the microcontroller U1 includes a diode D1 and a capacitor C6 connected in series with the emitter electrode of switch Q2 and in parallel with a resistor R18, and a resistor R1 connected in parallel with diode D1. The junction between diode D1 and capacitor C6 is connected to the "CLEAR" terminal 4 of microcontroller U1. Oscillations at a frequency of 4 MHz are applied to terminals OSC1 and OSC2 of the microcontroller by a resonator circuit consisting of an oscillator Y1 and a pair of capacitors C1 and C2 connected between the negative side of the voltage source and the first and second oscillator inputs, respectively.

Resistors R7 and R15 and capacitor C8 provide a means at microcontroller input terminal 12 for detecting gaps or drop outs in input power which indicate the presence of either a full wave rectified (FWR) input voltage or a sync or control pulse from the interface module 44.

In the alarm circuit of FIG. 3, the flash circuit portion utilizes an opto-oscillator for D.C.-to-D.C. conversion of the input voltage to a voltage sufficient to fire the flashtube. In the opto-oscillator, a capacitor C4 connected in parallel with the flashtube DS1 is incrementally charged, through a diode D2 and a resistor R5, from an inductor L2, which is cyclically connected and disconnected across the D.C. supply. At the beginning of a connect/disconnect cycle, the light emitting diode (LED) and transistor of an optocoupler U2 are both off and switch Q4 is on, completing a connection between inductor L2 and the D.C. power source. As the current flow through L2 increases with time, the LED of U2 energizes and turns on the optically coupled transistor of U2 which in turn shuts off switch Q4, thereby disconnecting L2 from the D.C. source. During the off period of switch Q4, energy stored in inductor L2 is transferred through diode D2 and resistor R5 to capacitor C4. Capacitor C7 and resistor R13 are connected in series between diode D2 and the base of the transistor of optocoupler U2. When inductor L2 has discharged its stored energy into capacitor C4, the LED of U2 ceases to emit light and the transistor of U2 turns off. This in turn causes Q4 to turn on, thereby beginning the connect/disconnect cycle again.

The on and off switching of Q4, and, therefore, the rate at which the increments of energy are transferred from inductor L1 to capacitor C1, is determined by the switching characteristics of optocoupler U2, the values of resistors R10, R11, R12, the value of inductor L2 and the voltage of the D.C. source, and may be designed to cycle at a frequency in the range from about 3000 Hz to 30,000 Hz. The repetitive opening and closing of switch Q4 eventually charges capacitor C4 to the point at which the voltage across it attains a threshold value required to fire the flashtube DS1. Overcharging of capacitor C4 is prevented by a resistor R14 and Zener diodes D4 and D7 connected in series between the base electrode of the optocoupler transistor and the positive electrode of storage capacitor C4. The values of these components are chosen so that when the voltage across capacitor C4 attains the firing threshold voltage of the flashtube DS1, a positive potential is applied to the base electrode of the optocoupler transistor and turns on the transistor which, in turn, turns off switch Q4 and disconnects inductor L2 from across the D.C. source.

In addition to the opto-oscillator, the flash circuit includes a circuit for triggering flashtube DS1. The trigger circuit includes a resistor R4 connected in series to the combination of a switch Q3, which in this embodiment is an SCR, connected in parallel with the series combination of a capacitor C5 and the primary winding of an autotransformer T1. The secondary winding of the autotransformer T1 is connected to the trigger band of the flashtube DS1. When switch Q3 is turned on, capacitor C4 discharges through the primary winding of transformer T1 and induces a high voltage in the secondary winding which, if the voltage on capacitor C4 equals the threshold firing of the tube, causes the flashtube DS1 to conduct and quickly discharge capacitor C4. Q3 is turned on from microcontroller output pin 1 and through a voltage divider composed of resistors R8 and R9.

The alarm unit depicted in FIG. 3 also includes an audio alarm circuit, comprised of resistor R2, transistor switch Q1, diode D14, inductor L1 and piezoelectric element 50 connected as shown. In the alarm unit shown, both the audio and visual alarm signals are controlled by the microcontroller U1, the audio signal being operated via output terminal 17 and the visual signal being triggered via output terminal 1. However, one skilled in the art will appreciate that a timer circuit means, such as disclosed in the copending, commonly-owned U.S. patent application Ser. No. 08/133,519, the pertinent contents of which are hereby incorporated by reference, can be employed to cause the strobe to flash independently of the microcontroller in the event of a malfunction which causes a failure of the microcontroller U3 in control unit 44 to send a sync signal.

By way of example, the circuit shown in FIG. 3, when using a 24 volt D.C. power source, may use the following parameters to obtain the above-described switching cycle:

| ELEMENT | VALUE OR NUMBER |
|---|---|
| C1, C2 | CAP., 33 pF, |
| C3 | CAP., 68 μF, 6 V |
| C4 | CAP., 68 μF, 250 V |
| C5 | CAP., 047 μF, 400 V |
| C6 | CAP., .47 μF |
| C7 | CAP., 33 pF, 250 V |
| C8 | CAP., .01 μF |
| D1 | DIODE 1N914 |
| D2, D14 | DIODE HER106 |
| D3 | DIODE 1N4007 |
| D4, D7 | DIODE 1N5273B |
| D5 | DIODE 1N4007 |
| D6 | DIODE 1N4626 |
| DS1 | FLASHTUBE |
| L1 | INDUCTOR, 47 mH |
| L2 | INDUCTOR, 2.2 mH |
| Q1 | TRANSISTOR, ZTX455 |
| Q2 | TRANSISTOR, 2N5550 |
| Q3 | SCR, EC103D |
| Q4 | TRANSISTOR, IRF710 |
| R1 | RES., 39K |
| R2 | RES., 560 |
| R4 | RES., 220K |
| R5 | RES., 180, ½ W |
| R6 | RES., 4.7K |
| R7 | RES., 10K, 1% |
| R8 | RES., 1K |
| R9 | RES., 10K, 1% |
| R10 | RES., 1K |
| R11 | RES., 1M |
| R12 | RES., 5.36 OHMS, 1% |
| R13 | RES., 100K |
| R14 | RES., 33K |
| R15 | RES., 2.21K, 1% |
| R16 | RES., 10K |
| R17 | RES., 330, ½ W |
| R18 | RES., 10K |
| T1 | TRIGGER TRANSFORMER |
| U1 | MICROCONTROLLER, P1C16C54 |
| U2 | OPTOCOUPLER, 4N35 |
| Y1 | CERAMIC RES., 4 MHZ |

As mentioned hereinabove, the microcontroller U1 of the alarm unit is responsible for activating and deactivating the audio horn alarm in a desired sequence, detecting FWR or D.C. voltage and adapting the visual strobe alarm to a low input voltage by lowering the flashrate. The flowcharts of FIGS. 4 and 4A–4E illustrate the software routines of the microcontroller of the alarm unit shown in FIG. 3.

Figure 4:
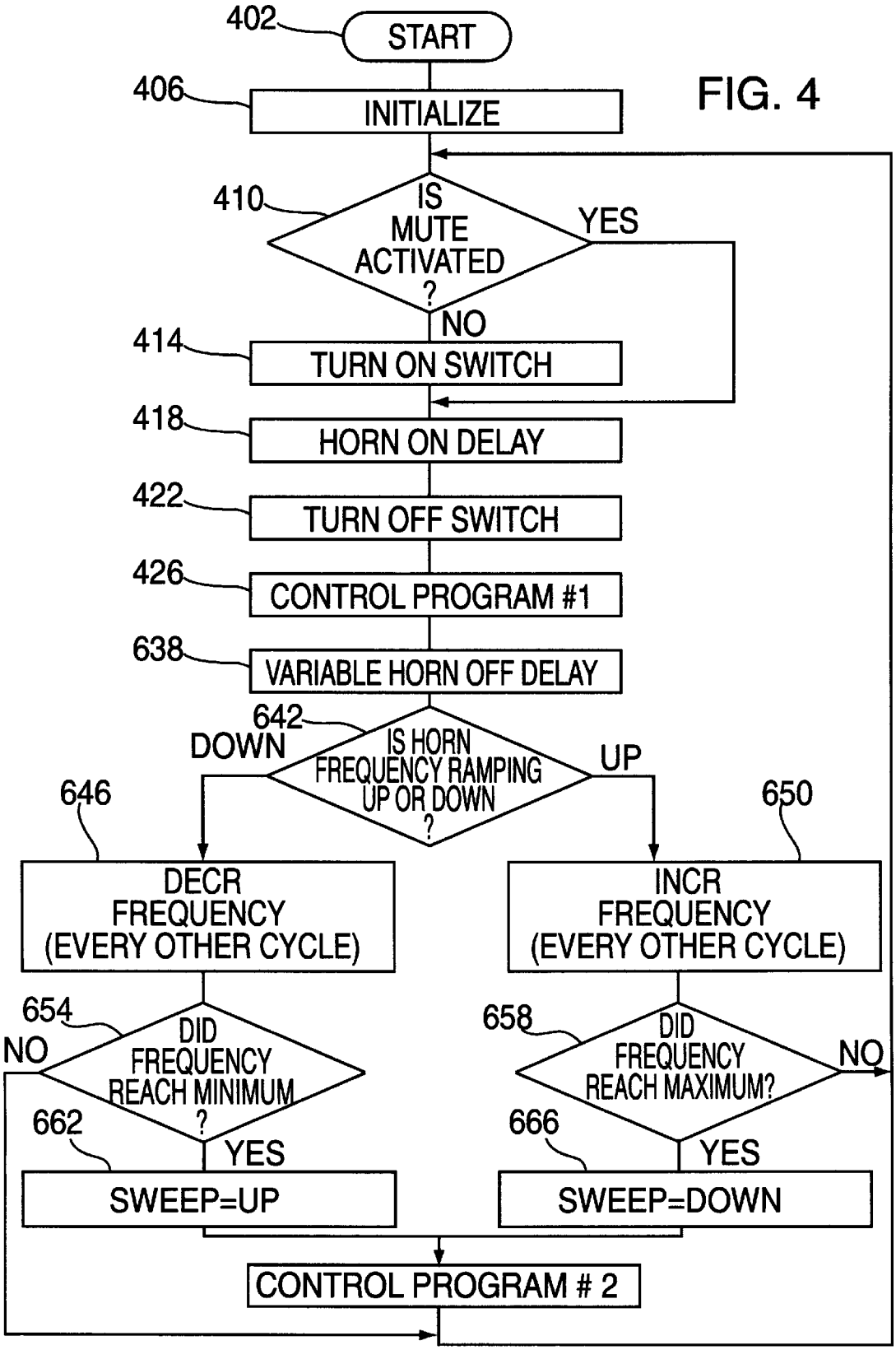
FIG. 4 illustrates the software routine of the main program.

FIG. 4 depicts the Main Program of the alarm unit microcontroller. This portion is responsible for the horn alarm and is executed at the desired center frequency for the horn, here approximately 3,500 Hz.

The program begins and is initialized at blocks 402 and 406. At block 410, an inquiry is made as to whether the horn is currently being muted, as will be the case if the Code 3 signal is in one of the half-second or one and one-half second silence periods or if the "SILENCE" feature has been activated. If the "MUTE" function is not activated, the microcontroller U1 will turn on the horn at block 414 by sending out a high signal from microcontroller terminal 17 to turn on switch Q1. In the preferred embodiment of the present invention, the horn is programmed to have a varying frequency, here between 3,200 and 3,800 Hz, to better simulate an actual horn, and will ramp up and down between the set minimum and maximum frequencies. In this embodiment, the "HORN ON DELAY" time, at block 418 is constant and is chosen to be approximately 0.120 msec. The varying of the horn frequency is accomplished by ramping the "HORN OFF DELAY" time up and down. Following the "HORN ON DELAY", the horn is turned off at block 422 by turning off switch Q1.

Figure 4A:
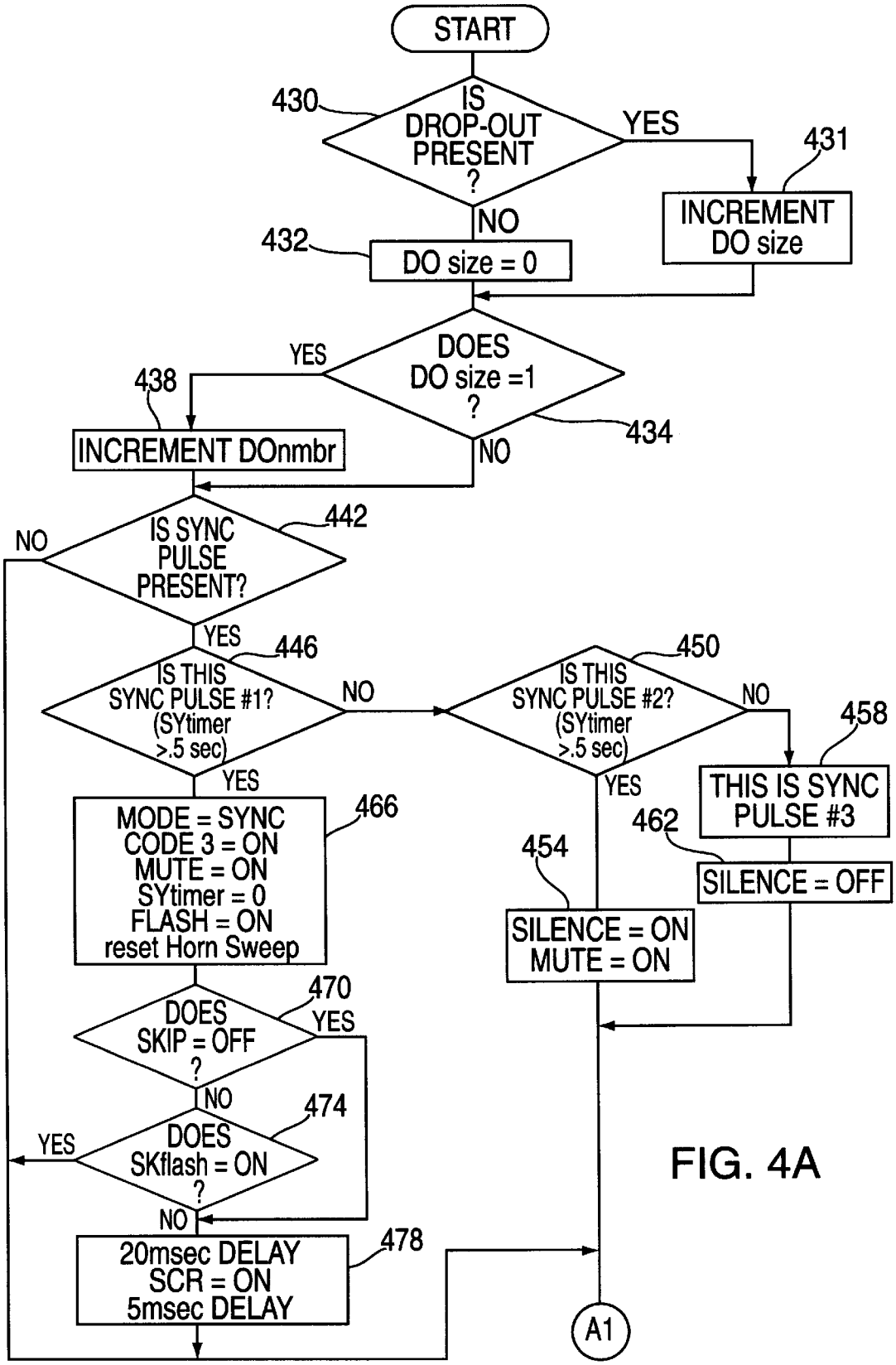
FIGS. 4A and 4B illustrate the software routine of Control Program No. 1.
Figure 4B:
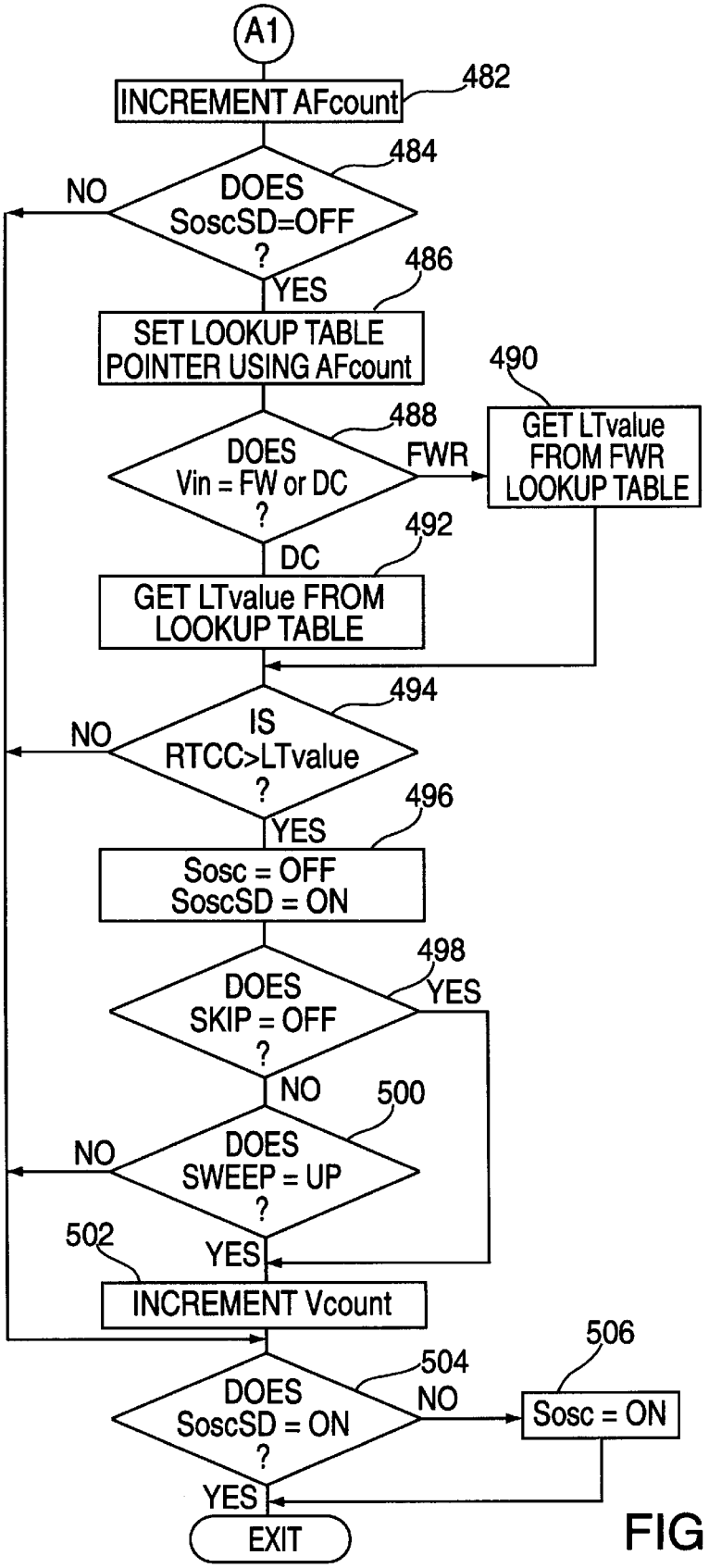

At block 426, Control Program No. 1 is run. Control Program No. 1 is responsible for detection and interpretation of the voltage dropouts, which serve as sync or control pulses (hereinafter "sync/control pulses") to the units, and is represented in flow-chart form in FIGS. 4A and 4B. FIGS. 4A and 4B will be discussed in detail hereinbelow following the discussion of FIG. 4.

After leaving Control Program No. 1, the main program, at block 638, will begin the "HORN OFF DELAY". As mentioned above, the "HORN OFF DELAY" time will be varied to better simulate an actual horn sound. At block 642, the program will check to see whether the delay is currently being ramped up or down, and, in either of block 646 or 650, will continue the ramping in the current direction on every other Main Program cycle. At either block 654 or 658, the program will loop back to bloc 410 to determine if the "MUTE" function has been activated if neither the minimum nor maximum specified horn frequency has been reached, in this example 3,200 and 3,800 Hz, respectively. If the minimum or maximum frequency has been reached, the ramp direction will be changed at block 662 or 666, after which the program will run Control Program No. 2, depicted in FIGS. 4C, 4D and 4E.

Turning now to FIGS. 4A and 4B, following the start of Control Program No. 1 the software looks for an input voltage drop out as indicated at block 430. Detection of a drop out indicates either a sync/control pulse or a FWR input voltage. Detection of the leading edge of a drop out initiates a counter "DOsize". If the drop out is present, "DOsize" is incremented at block 431. If no drop out is present, the counter is reset to zero at block 432. Drop outs are detected at microcontroller input terminal 12.

Next, at block 434, the program checks to see if this is the beginning of a drop out by inquiring as to whether "DOsize= 1. " If so, the program at block 438 increments a counter, "DOnmbr", which keeps track of the number of dropouts. At block 442, the program checks for the presence of a sync/control pulse using the "DOsize" counter. If the drop out is wide enough, a sync/control pulse is present.

One skilled in the art will appreciate that multiple pulses can be used as control signals for the system. According to the present invention, in any such scheme, the first pulse will indicate the beginning of a new sync cycle. By way of example, here, the presence of a second pulse immediately following the first sync pulse will activate the "SILENCE" feature throughout the system and turn off any audio alarm which may be sounding. The presence of a pulse in the first and third pulse positions will deactivate the "SILENCE" feature causing the horns to sound when activated.

The software needed to perform these functions is illustrated in the flowchart of FIG. 4A following block 442. If a sync/control pulse is detected, the program at block 446 determines whether it is a sync pulse by checking the how much time has elapsed since the last pulse. If "SYtimer" indicates that it has been more than 0.5 seconds, then the pulse is the first of the cycle. If less than 0.1 seconds has elapsed, then the pulse is determined at block 450 to be in the second position and the "SILENCE" and "MUTE" features are activated at block 454. In this example, since only three pulse positions are being used, if "SYtimer" is any other value, then the pulse is determined at block 458 to be in the third position and the "SILENCE" feature is deactivated at block 462.

If the pulse is a sync pulse, block 466 sets several functions. "MODE" is set to "sync", "CODE 3" is turned on, "MUTE" is turned on, "SYtimer" is reset to zero, "FLASH" is turned on, and the horn frequency is returned to its starting position.

At block 470, the program checks to see if the "SKIP" function is off. The "SKIP" function and "SKflash" variable are used to cut the flashrate in half when the input voltage falls below an acceptable level, in this example 20 V. When the "SKIP" function is activated, the variable "SKflash" will toggle between on and off once each flash cycle causing every other flash to be skipped. This is seen in the flowchart at block 474 where if "SKIP" is not off, the program checks to see whether "SKflash" is on, which it will be every other cycle. On the other hand, if "SKIP" is off at block 470, the program jumps to block 478 and flashes the strobe by delaying 20 msec, turning on SCR Q3 and delaying another 5 msec. If "SKpulse" is on at block 474, block 478 will be skipped and the strobe will not be flashed.

The next section of the program, beginning at block 482 in FIG. 4B, checks to see whether the capacitor C4 is being charged high enough to sufficiently flash the flashtube DS1. At block 482, a variable "AFcount" is incremented. "AFcount" is used to count the number of cycles of Control Program No. 1 which corresponds to the audio frequency of the audio alarm signal.

At block 484, inquiry is made as to the status of a control variable "SoscSD", which is indicative of the "oscillator shut down" function. "SoscSD" being on indicates that the opto-oscillator is shut down. If "SoscSD" is off, the program continues with box 486 which sets a lookup table pointer based on "AFcount", i.e., based upon how many audio signal cycles have elapsed. The lookup table value, "LTvalue", is a predetermined minimum desirable number of cycle counts for the opto-oscillator and is used to determine whether capacitor C4, which provides the energy to flash flashtube DS1, is charging too quickly. First, however, at block 488, the program determines whether Vin is FWR or D.C. Depending on which one it is, the program will determine "LTvalue" using either a FWR lookup table at block 490 or a D.C. lookup table at block 492.

Next, at block 494, "LTvalue" is compared to the number of connect/disconnect cycles of the opto-oscillator responsible for charging C4. This is done by using the real time clock counter at microcontroller input pin RTCC and resistor R16 to keep count of the number of times the opto-oscillator has cycled. If the count is greater than "LTvalue", then the oscillator is turned off at block 496 by turning on "SoscSD" and turning off "Sosc".

At block 502, a variable "Vcount" is incremented. "Vcount" is used to determine whether the alarm unit is receiving a proper input voltage. Its significance will be discussed in greater detail shortly hereinbelow.

Returning briefly to block 484, if "SoscSD" is not off, that is, if the "oscillator shut down" function is on, then the program jumps to block 504 and will not increment "Vcount". As will be seen hereinbelow, once "SoscSD" is turned on, it will not be turned off again until Control Program No. 2 is executed. As discussed above with respect to the Alarm Unit Main Program, Control Program No. 2 is executed only at the top and bottom of the horn sweep cycles. The number of times this occurs can be controlled by the size of the step of the horn frequency increase or decrease. In the example under discussion, this will happen 120 times each second, one second being the approximate period between flashes. Therefore, the highest value which "Vcount" can attain between flashes is 120. This is also true when the "SKIP" function is activated and the flash period becomes two seconds, i.e., Control Program No. 2 is executed 240 times between flashes, since blocks 498 and 500 allow "Vcount" to be incremented only if either the "SKIP" function is off or both the "SKIP" function is on and the horn frequency is sweeping up.

Returning to block 494, if RTCC has not exceeded "LTvalue", the program jumps to block 504 and "Vcount" will not be incremented. At block 504, the program checks to see if the "oscillator shut down" function is on. If not, the oscillator is turned on at block 506 and the control program is exited. If "SoscSD" is on, the control program is exited without turning on "Sosc".

Figure 4C:
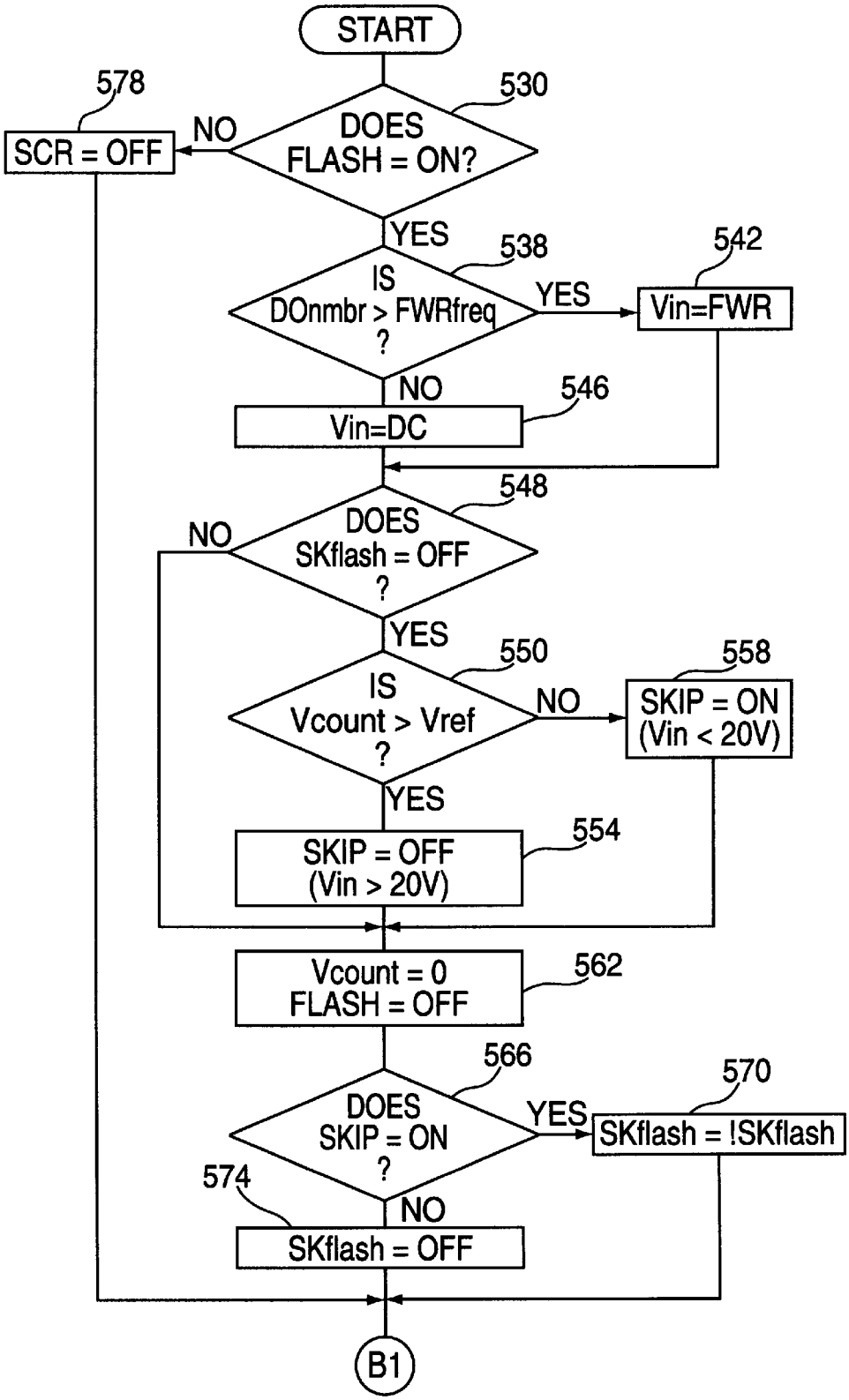
FIGS. 4C, 4D and 4E illustrate the software routine of Control Program No. 2; of the microcontroller of the alarm unit shown in FIG. 3.
Figure 4D:
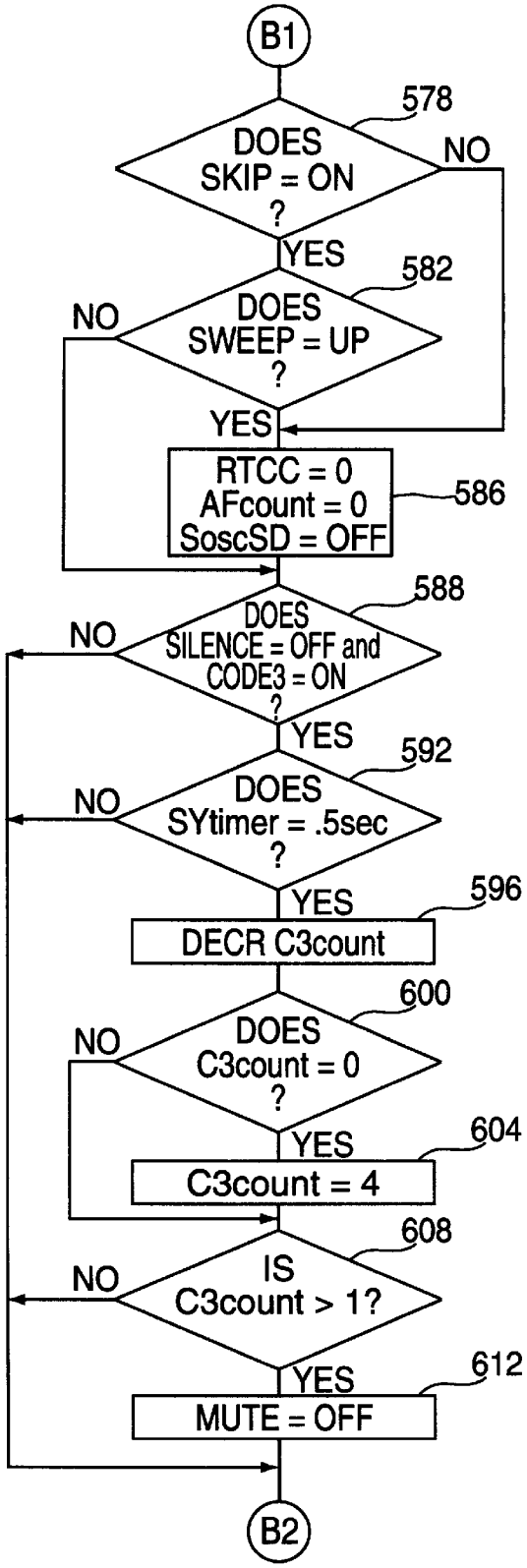
Figure 4E:
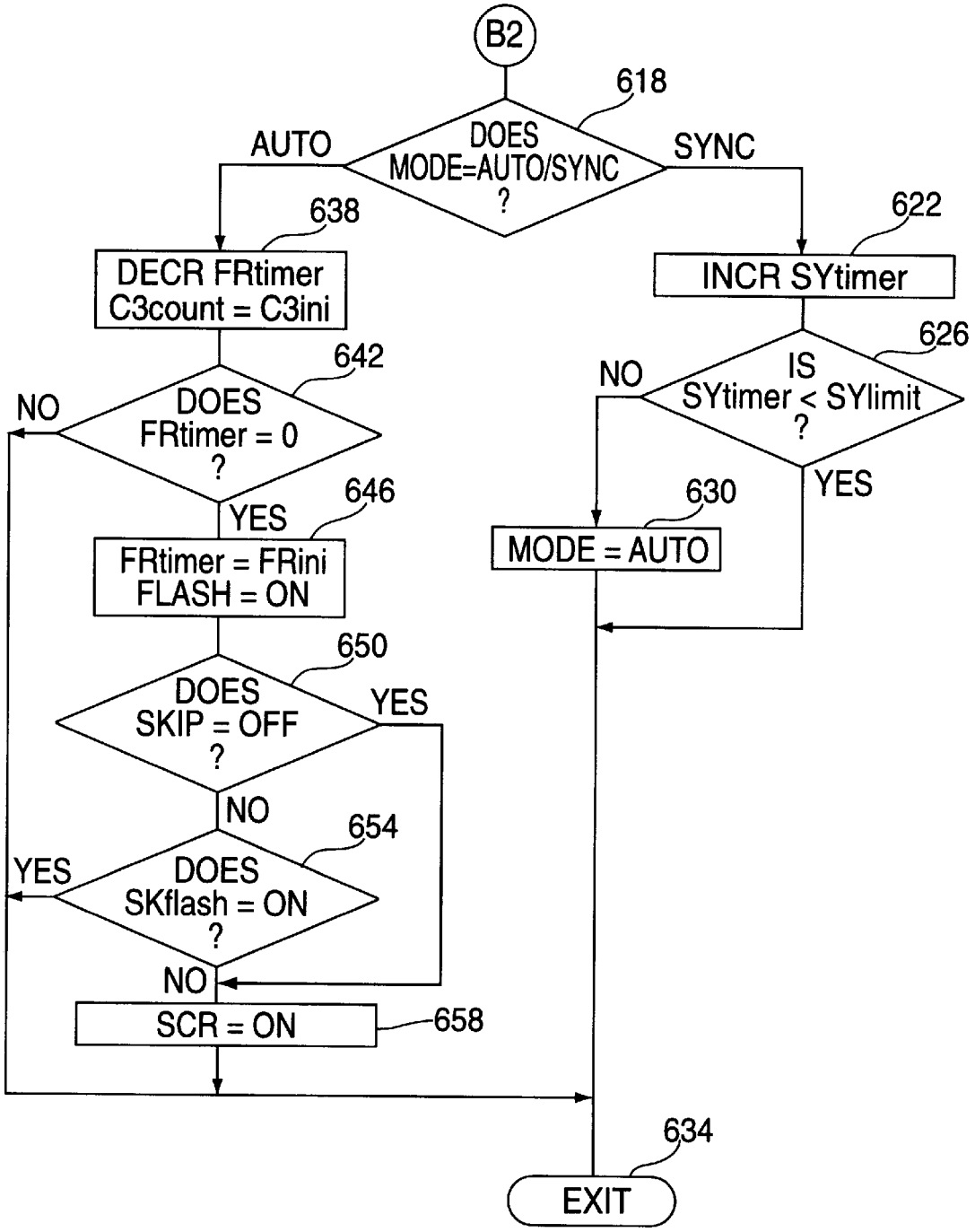

Now, turning to FIGS. 4C, 4D and 4E, which represents the flowchart for Control Program No. 2, the program checks at block 530 to see if the "FLASH" function has been activated. If not, at block 578, SCR Q3 of the alarm unit is turned off via pin 1 of the microcontroller and the next several program functions relating to determination of the input voltage are passed over.

If the "FLASH" function is on, the program, at blocks 538, 542 and 546, checks to see whether the number of drop outs, represented by the variable "DOnmbr", indicates that a FWR input voltage is being used, and the variable "Vin" is set to the appropriate input voltage type, either FWR or D.C.

The next function carried out by the micro-controller software relates to the feature discussed briefly hereinabove whereby the alarm unit will compensate for a below-nominal input voltage by lowering the flash frequency. More particularly, when the input voltage is determined to be below 20 volts, the flash frequency will be cut in half to approximately 0.5 Hz, or one flash every two seconds. Determination of the input voltage is accomplished using the variable "Vcount" which, as previously discussed, under certain circumstances is incremented in Control Program No. 1 when the opto-oscillator has not been shut down and the real time clock counter as represented by variable "RTCC" has exceeded "LTvalue".

Before performing this function, however, the program at block 548 checks to see if "SKflash" is off. If not, then the voltage check is passed over and the program proceeds to block 562. If, on the other hand, the current flash is not being skipped, then at block 550 "Vcount" is compared to a predetermined constant, "Vref".

As discussed above, "Vcount" will never be incremented higher than 120 within the time period between flashes, and, if the input voltage is over 20 volts, "Vcount" should be incremented all the way to 120 during each flash cycle. If the input voltage is below 20 volts, "Vcount" should be zero. In the embodiment under discussion, the value of "Vref" is chosen to be 30 which will smooth the switch between flashrates.

If, at block 550, "Vcount" exceeds "Vref", the input voltage is determined to be at least 20 V and the "SKIP" function is deactivated at block 554. If "Vcount" is less than "Vref", the input voltage is determined to be less than 20 V and the "SKIP" function is turned on at block 558. After the comparison, "Vcount" is reset to zero and the "FLASH" function is turned off at block 562.

Next, at block 566, the program determines whether the "SKIP" function is on. If so, "SKflash" is toggled at block 570. If not, "SKflash" is turned off at block 574. At block 578 (see FIG. 4D), the program again checks whether the "SKIP" function is on. If not, the program resets "RTCC" and "AFcount" to zero and turns off "SoscSD" at block 586. If "SKIP" is on, then block 582 ensures that block 586 will be executed only if the horn frequency is currently being swept upward.

The software continues at block 588 which determines whether the "SILENCE" function is off and the "CODE 3" function is on. If not, the program skips the next function, which is maintenance of the Code 3 horn signal, and goes directly to block 618. If the conditions are met at test 588, the time since the last sync pulse, represented as "SYtimer", is checked at block 592. If it is equal to 0.5 seconds, then the variable "C3count", which keeps track of the sync pulses in each Code 3 signal cycle, is decremented at block 596.

Figure 7A:
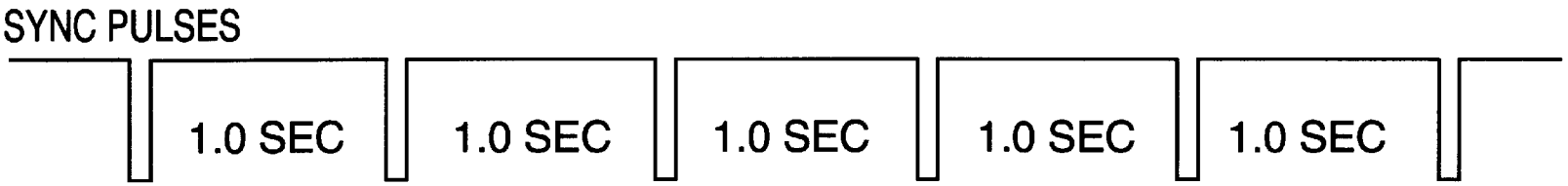
FIGS. 7A and 7B are diagrams showing the relationship between the system sync signal and the audio alarm signal of one embodiment of the present invention.
Figure 7B:
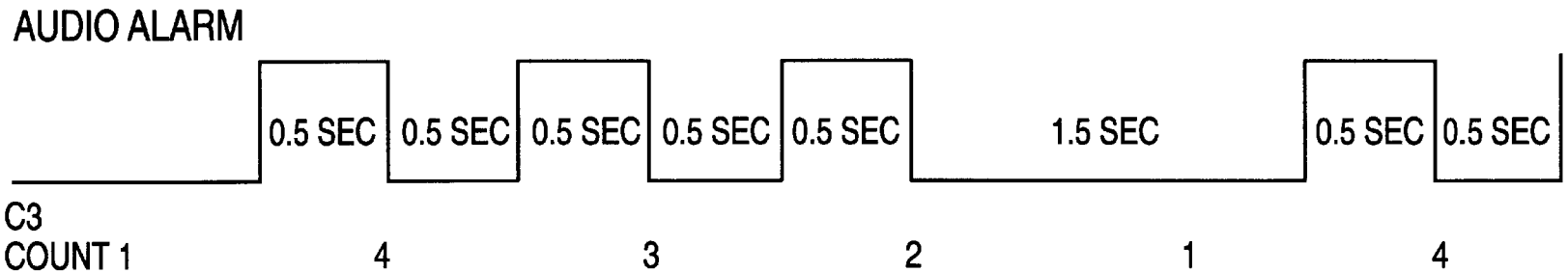

The relationship among "C3count", the sync pulses and the audio Code 3 horn signal is shown in FIGS. 7A and 7B. Each sync pulse triggers one-half second of silence followed by a one-half second horn blast, except when "C3count"=1. During that sync cycle, the horn blast is muted.

After decreasing "C3count", the program checks at block 600 to see if "C3count" is zero. If not, block 604, which sets "C3count" to 4, is skipped. Next, block 608 checks to see if "C3count" is greater than 1. If so, the "MUTE" function is turned off at block 612. If not, block 612 is skipped and the program moves to the next task.

At block 618 (see FIG. 4E), the program checks which mode the system is currently in, auto or sync. If it is in sync mode, "SYtimer" is increased at block 622. Block 626 compares "SYtimer" to the predetermined maximum time, "SYlimit", at which the system should be allowed to continue in the sync mode. If "SYtimer" is not less than "SYlimit", then there is a problem with the sync pulses and the mode is switched to auto at block 630. If not, the mode is left at sync and Control Program No. 2 is exited at block 634.

If the system is in auto mode, that is, the alarm units are operating independently of one another, "FRtimer", a variable which keeps track of the time since the last flash when in the auto mode, is decremented at block 638 and "C3count" is set to its initial value, "C3ini ". At block 642, if "FRtimer" is not down to zero, Control Program No. 2 is exited. If "FRtimer" is zero, it is set to its initial value, "FRini", at block 646, and the "FLASH" function is turned on. Then, block 650 checks to see if the "SKIP" function is off. If not, block 654 checks to see if "SKflash" is on. If "SKflash" is on then control program No. 2 is exited. If not, the program flashes the strobe at block 658 by turning on SCR Q3. Returning to block 650, if the "SKIP" function is off, the program jumps to block 658 which flashes the strobe and exits.

Figure 5:
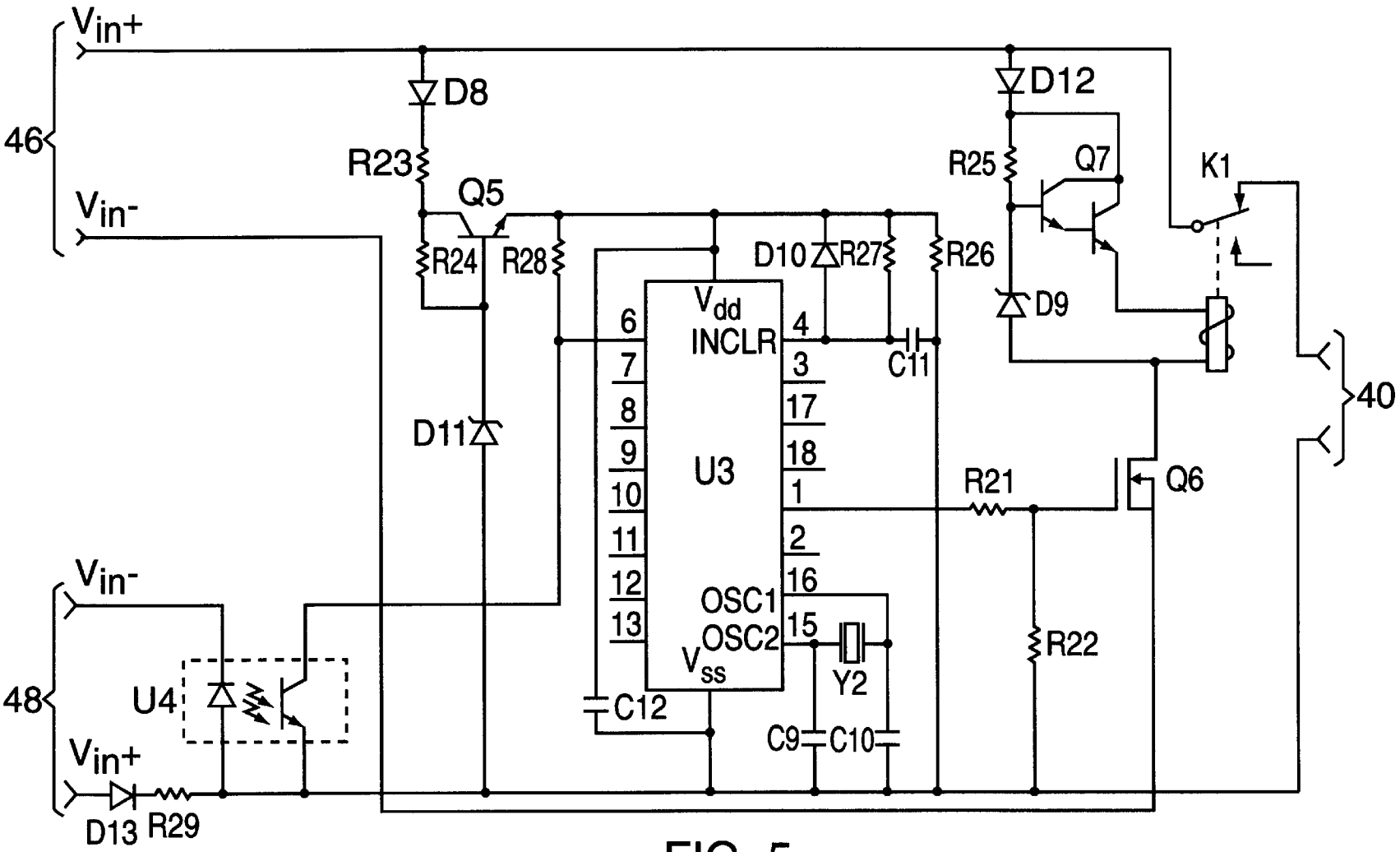
FIG. 5 is a circuit diagram of one embodiment of the interface control circuit of the present invention.

Turning now to the interface control circuit 44 of the invention, the preferred embodiment is shown in FIG. 5 connected across a D.C. voltage source which supplies a voltage Vin. The input voltage enters the interface via the primary loop 46 and normally passes through single pole single throw relay K1 and out of the interface to the system control loop 40. The D.C. voltage source is typically housed in the fire alarm control panel 25 and $V_{in}$ is nominally 24 volts. As discussed above, this voltage may have a wide range of values and the present invention can compensate for unexpected drops in voltage below what is necessary to operate the system at the flash rate of 1.02 Hz noted above.

The supply voltage $V_{in}$ is also applied through a diode D8, which typically has a voltage drop of 0.7 volts, to a regulator circuit which includes resistors R23 and R24, a transistor switch Q5 and Zener diode D11 connected as shown, with values chosen so as to provide a regulated 5.00 volts ±5% volts to the $V_{dd}$ input of microcontroller U3. Resistor R23 is between the cathode of diode D8 at one end and both the resistor R24 and the collector of switch Q5 at the other end. The other end of R24 is connected to the base of switch Q5. A capacitor C12 connected across the $V_{dd}$ and $V_{ss}$ terminals of U3 acts as a filter.

Resistors R26 and R27, capacitor C11 and diode D10 comprise a reset circuit for microcontroller U3. Resistor R27 is connected at one end to the emitter of switch Q5, the cathode of diode D10 and resistor R26, and at the other end to the "CLEAR" terminal 4 of microcontroller U3, the positive terminal of capacitor C11 and the anode of diode D10. The other end of resistor R26 is connected to the negative terminal of capacitor C11. Resistor R28 is connected between the emitter of switch Q5 at one end and terminal 6 of microcontroller U3 and optocoupler U4 at the other end, to provide a control input to microcontroller U3 for any one or more desired functions.

Oscillations at a frequency of 4 MHz are applied to terminals OSC1 and OSC2 of the microcontroller by a resonator circuit consisting of an oscillator Y2 and a pair of capacitors C9 and C10 connected between the first and second oscillator inputs, respectively.

In the preferred embodiment, the secondary loop 48 is used as an input for control signals. In the example under discussion, the control signals relate to the "SILENCE" feature which turns off the audio alarm in each of the alarm units while allowing the visual alarm to continue. The secondary loop 48 may also be used to provide an audio alarm control signal from the fire alarm control panel to the multiple alarm units. The latter function is implemented where the fire alarm system is already equipped with the capability to provide a desired alarm sequence, Code 3 in the preferred embodiment, and provides the necessary control signals to the system. In the case where the system does not have Code 3 capabilities, the interface unit can be programmed to provide the Code 3 control signals to the alarm units as will be described hereinbelow.

The secondary input loop 48 of the interface control circuit is connected across a D.C. source. An input from the control panel will be in the form of a power interrupt, or "drop out", which is detected by the microcontroller U3 at pin 6. Normally, voltage is applied at the secondary loop across the series connection of diode D13, resistor R29 and optocoupler U4. The LED of U4 turns on the transistor of U4 thereby causing current to flow across R28 and a voltage at pin 6 of microcontroller U3. Interruption of the D.C. source will turn off the transistor of U4 and pull pin 6 of U3 to $V_{dd}$ or 5 V.

The direct connection from the primary loop input 46 to the control loop output 40 may be interrupted by activating the relay K1 which is accomplished by turning on switch Q6. Switch Q6 is turned on by an output of microcontroller U3 which is applied to the gate of switch Q6 via a voltage divider including a resistor R21 connected from output pin 1 of microcontroller U3 to the gate, and a resistor R22 connected from the gate electrode to the negative side of the power source.

When Q6 is closed, the potential at the output emitter of switch Q7, which preferably comprises a Darlington pair, is pulled to that of the negative side of the power source, causing Q7 to conduct. The voltage applied to the base electrode of one transistor of the Darlington pair Q7 is regulated by a resistor R25 and a Zener diode D9 in a series connection between the cathode of diode D12 and the end of the coil of relay K1 that is connected to switch Q6. When Q7 conducts, current flows through the coil of relay K1 and switches the relay from its normal position to the other contact. Actuation of the relay causes an interruption of the D.C. voltage normally supplied to the controlled alarm units.

The power drop outs can be used for any one of a number of control functions, "silence" being the example provided. Under the scheme discussed hereinabove, commands based on the position of sync/control pulses are sent to each alarm unit simultaneously. A more flexible alternative to pulse position coding is pulse train binary coding. One skilled in the art will appreciate that with a pulse train of, for example, eight pulse positions, several positions in the train can be assigned to the task of addressing commands to individual alarm units. One can envision circumstances where this would be advantageous, such as where one seeks to deactivate alarms on a particular floor while allowing the alarms to continue on others.

The interface control circuit 44 is capable of operating in three different modes. Which one of the three modes it will operate in depends on the capabilities of the existing system. The interface control circuit will operate in mode 1 in a system which is not equipped with Code 3 or silence capabilities. For mode 1 operation, the interface control circuit is installed with the primary loop, and the Code 3 signalling is performed by the interface control circuit as described earlier, not the fire alarm control panel. In mode 1, a silence feature is not available.

Mode 2 is used where the existing system has a silence feature, but not a Code 3 capability. In that case, the interface control circuit is installed with both a primary and secondary input loop, the secondary input loop being available for a silence signal from the control panel. As in mode 1, Code 3 is performed by the interface control circuit.

Finally, mode 3 is available for systems which already have Code 3 and silence function capabilities. Here, the interface control circuit is installed with both a primary and secondary input loop. The Code 3 control signal originates in the control panel as does the silence control signal.

By way of example, the interface control circuit under discussion and shown in FIG. 5, when energized from a 24 volt D.C. power source, may use the following parameters:

| ELEMENT | VALUE OR NUMBER |
|---|---|
| C9, C10 | CAP., 33 pF |
| C11 | CAP., .47 μF |
| C12 | CAP., 15 μF, 16 V |
| D8 | DIODE, 1N4007 |

-continued

| ELEMENT | VALUE OR NUMBER |
|---|---|
| D9 | DIODE, 1N5326, 7.5 V |
| D10 | DIODE, 1N914 |
| D11 | DIODE, 1N4626 |
| D12 | DIODE, 1N4007 |
| D13 | DIODE, 1N4007 |
| K1 | RELAY, DPST |
| Q5 | TRANSISTOR, 2N5550 |
| Q6 | TRANSISTOR, 1RF710 |
| Q7 | TRANSISTORS, T1P122 |
| R21 | RES., 220 |
| R22 | RES., 100K |
| R23 | RES., 330 |
| R24 | RES., 4.7K |
| R25 | RES., 4.7K, ½ W |
| R26 | RES., 10K |
| R27 | RES., 39K |
| R28 | RES., 10K |
| R29 | RES., 2.7K, ½ W |
| U3 | MICROCONTROLLER, PIC16C54 |
| U4 | OPTOCOUPLER, 4N35 |
| Y2 | CERAMIC RES., 4 MHZ |

Figure 6:
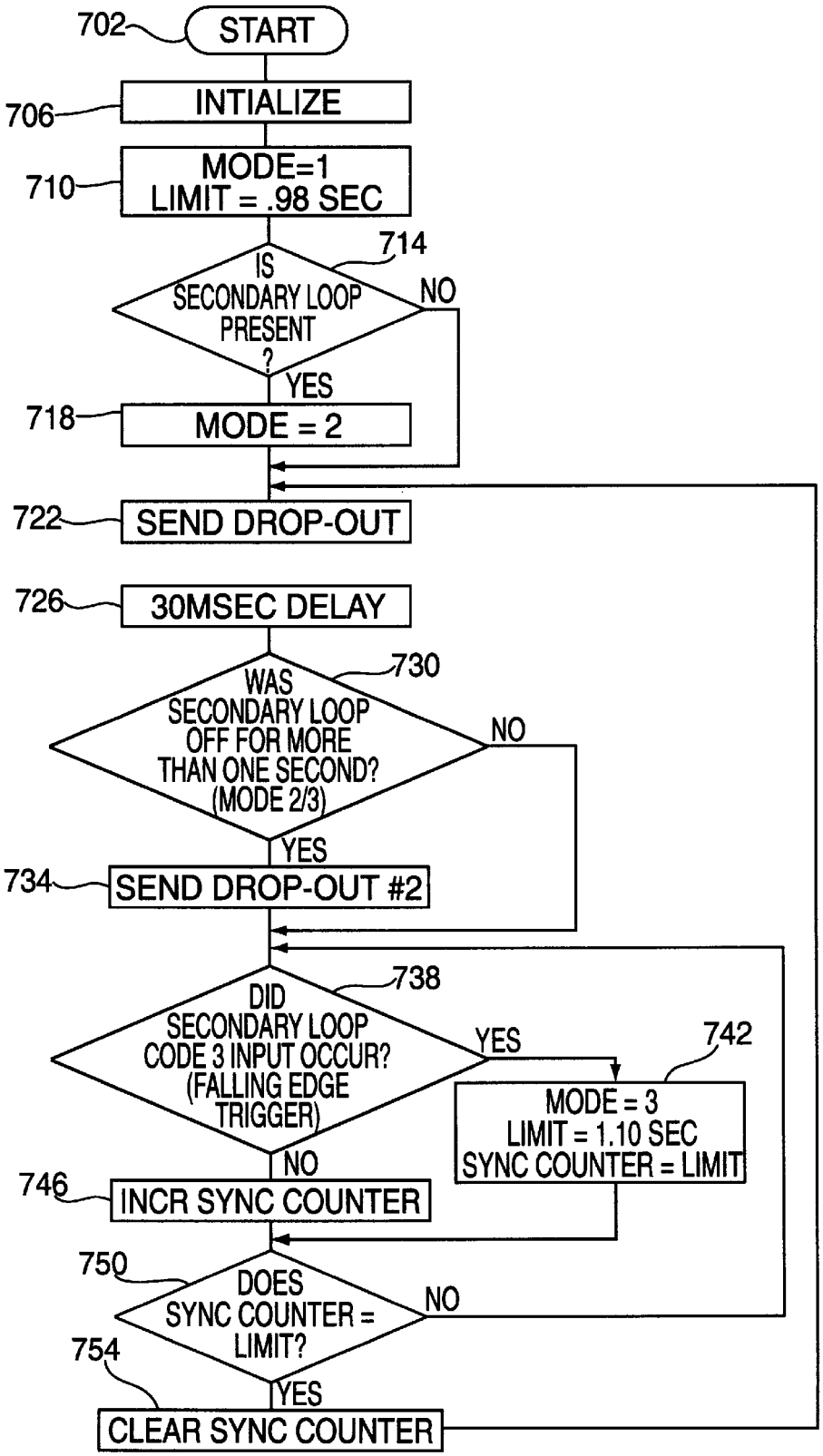
FIG. 6 illustrates the software routine of the microcontroller of the interface control circuit shown in FIG. 5.

The microcontroller U3 of the interface control circuit of FIG. 5 is responsible for closing switch Q6 and thus transmitting power drop outs which will be interpreted by the alarm units as described earlier. FIG. 6 illustrates the software routine of the microcontroller U3. At blocks 702 and 706, the program begins and is initialized. At block 710, mode 1 is assumed and the sync period limit is set to 0.98 seconds. Block 714 is an inquiry as to whether the secondary loop is present in the alarm system. If so, at block 718, the mode is set to mode 2. At blocks 722 and 726, a drop out of 30 msec duration which acts as the sync pulse is sent on the output control loop. Where the system is operating in either mode 2 or 3, the program inquires at block 730 as to whether there has been an interrupt in power of more than one second to the secondary loop, which would indicate a silence signal from the control panel. If so, at block 734 a second "drop out" is sent to the alarm units almost immediately. Although not shown in FIG. 6, one skilled in the art will appreciate that the silence feature can be similarly deactivated by another input of significant duration to the secondary loop after which a dropout in the third pulse position, for example, is sent to the interface control circuit.

Next, at block 738, the program looks for an input indicative of Code 3 from the control panel on the secondary loop. If one is detected, block 742 sets the mode number to 3, sets the sync period limit to 1.10 seconds and sets the sync counter to the limit, 1.10 seconds. This slight increase in the sync period ensures proper Code 3 operation when Code 3 signals are originating from the control panel 25 rather than the interface control circuit 44. If the Code 3 input is not detected, the sync counter is incremented at block 746. Next, at block 750, the program looks at whether the sync counter has reached the set limit. If so, the program clears the sync counter at block 754 and loops back to block 722, thereby sending a drop out. If the limit has not been reached, the program loops back to block 738.

In accordance with the invention, a control circuit is provided which causes multiple strobes connected in a common circuit or loop to flash at the same time, in synchronism, at a rate no higher than a predetermined rate, for example, 5 flashes per second. The control circuit, which may either be incorporated in the fire alarm control panel which controls the loop, or interposed between the fire alarm control panel and the loop of strobes, derives its power from the control panel in the same way as the strobes do: during supervision when the polarity of the power supply is reversed, it uses no power, but when an alarm condition is present it becomes powered and starts operating in a sync: mode. When in the sync mode, once every flash cycle, typically at intervals of 2.9 seconds, the control circuit interrupts power to all of the strobes for a period of from 10 to 30 milliseconds, this being the signal which causes all of the strobes in the loop to flash. At the same time, this signal resets the internal timer of each flash unit to ready it for arrival of the next sync signal. In the event no sync signal arrives after an interval exceeding 2.9 seconds, each strobe unit will flash when its flash timer completes its cycle.

The synchronizing control circuit of the invention may be used in conjunction with a variety of strobe circuit designs, preferably having the following desirable properties: (a) an energy limiter operable over a predetermined voltage range in the sync mode; (b) a trigger circuit which is responsive to the sync signals; and (c) a resettable timer for recycling the strobe unit in a non-sync mode in case of lack of the sync signal.

Figure 8:
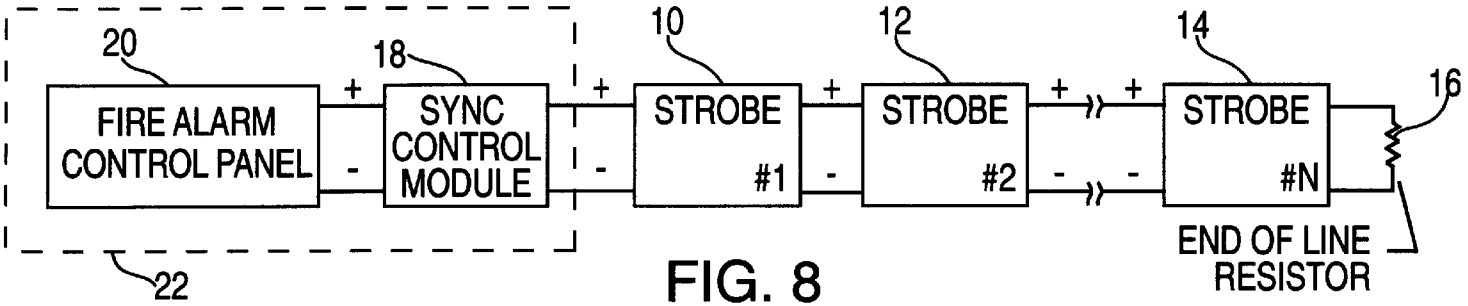
FIG. 8 is block diagram of a synchronized strobe system according to the invention.

Referring to FIG. 8, multiple strobe circuits 10, 12 and 14 numbered from 1 to N, connected in a common loop and having the usual end of line resistor 16, are all caused to flash at the same time, in synchronism, by a sync control circuit 18. The sync control module 18 may either be incorporated in a conventional fire alarm control panel 20, as indicated by the dotted line enclosure 22 , or may be a free-standing unit interposed between the control panel and the first strobe circuit 10 of the loop. Sync control module 18 is energized from a D.C. power source embodied in control panel 20 in the same way that loop-connected strobes are usually energized in a supervised alarm system. During supervision, when the polarity of the power supply is reversed from that indicated in FIG. 8, module 18 uses no power (nor does it supply power to the strobes), but when an alarm condition is present the polarity of the voltage is as shown, which causes the control module to commence operation in a sync mode, which includes supplying D.C. power to the multiple strobes via a two-wire loop. The sync control module causes all of the strobes in the loop to cyclically flash in synchronism by periodically interrupting the supply of power to the strobes. Typically, the power is interrupted for a period of from 10 to 30 milliseconds, at intervals of 2.9 seconds, so as to cause all strobes to flash once about every 3 seconds. This flash rate satisfies the UL requirement of a minimum of one flash every three seconds and a maximum of three per second. This synchronizing signal, namely, the brief interruption in the supply voltage, in addition to triggering firing of the multiple strobes also resets the internal timer of each strobe unit to ready it for arrival of the next sync signal, and to enable it to self-fire in the event no synchronizing signal arrives after an interval exceeding 2.9 seconds following the last previous flash.

As will later be explained in detail, sync control circuit 18 is designed to synchronize flashing of multiple loop-connected strobes of various designs including, for example, modifications of the optocoupler strobe circuit described in U.S. Pat. No. 5,121,033 granted on Jun. 9, 1992 to applicant Kosich, and of the microprocessor-controlled strobe disclosed in applicants' U.S. patent application Ser. No. 08/061,965 filed May 14, 1993, and assigned to the same assignee as the present application. In order for the present sync circuit to work with a particular one of these strobe circuits, the strobe must be modified to include as a minimum the features and properties embodied in the basic strobe circuit depicted in FIG. 9, several of which may be connected in the loop of the system shown in FIG. 8. The flash unit 10 includes a flashtube DS1 shunted by a trigger circuit which includes a resistor R1 connected in series with the combination of a timer trigger 32 connected in parallel with the series combination of a capacitor C1 and the primary winding of an autotransformer T1. The secondary winding of the autotransformer is connected to the trigger band of the flashtube and when timer trigger 32 is fired capacitor C1 discharges through the autotransformer and produces a high voltage trigger pulse which, if the voltage across the flashtube, as determined by a capacitor C2 connected in parallel with the flashtube, exceeds its threshold firing voltage, causes the flashtube to conduct and quickly discharge capacitor C2.

Capacitor C2 is incrementally charged from a suitable D.C.-to-D.C. oscillator 34 through an inductor L1 which is connected to the positive terminal of capacitor C2 through a resistor R2 connected in series with a diode D2. The node between inductor L1 and resistor R2 is connected to ground through a switch Q1, which may be a MOSFET. The D.C.-to-D.C. oscillator 34 is connected across a D.C. voltage source, represented by V.sub.in, and includes means for closing and opening switch Q1 for connecting and disconnecting inductor L1 across the D.C. source. Energy is stored in the inductor during closed periods of the switch and this stored energy is transferred from the inductor to capacitor C2 during open periods of the switch. The repetitive opening and closing of switch Q1, which may cycle at a frequency in the range from about 3,000 Hz to about 30,000 Hz, will eventually charge capacitor C2 to the firing threshold voltage of the flashtube.

Faced with the reality that the supply voltage to strobe alarms, even through typically D.C., may vary between wide limits, in order to meet UL specifications that the flash rate of the strobe must meet minimum requirements for the range of voltages for which the strobe is to operate, strobe circuits have heretofore been designed to expend the required energy for the lowest reasonably expected voltage. As a consequence, supply voltages greater than the lowest reasonably expected value would unnecessarily expend energy in the flash above the minimum, more often than needed and/or in a non-useful manner. For example, the capacitor C2 connected across the flashtube charges faster for higher input voltages; thus, if the flash is actuated when the potential across the capacitor attains the threshold firing voltage of the flashtube, the flash rate will increase, resulting not only in a waste of energy but also unnecessary wear and tear on the capacitor. In the case of the flashtube being triggered by a separate timing circuit, such as the timer trigger 32, a higher input voltage will cause overcharging of the storage capacitor, or at least make it necessary to provide a larger capacitor than should be necessary. As a result, the potential across the capacitor will cause a brighter than necessary flash, thereby wasting energy.

Figure 9:
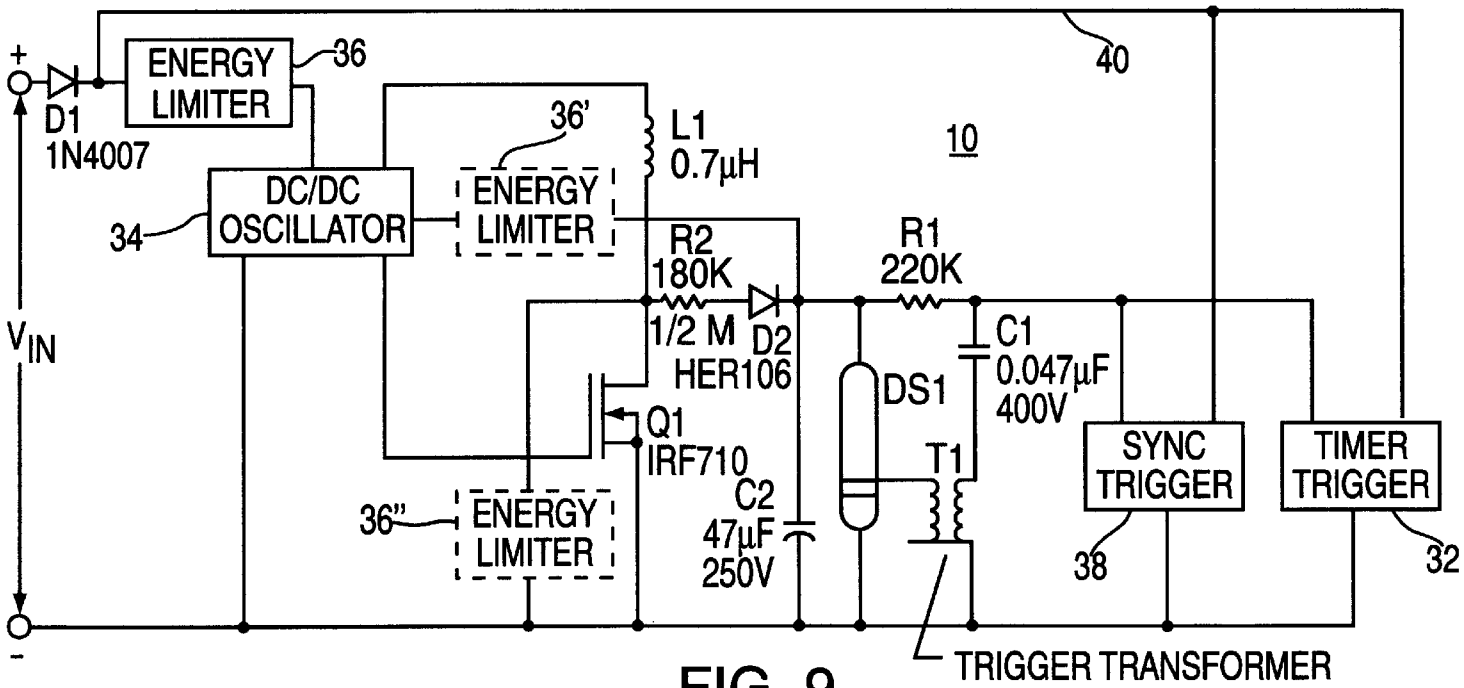
FIG. 9 is a circuit diagram, partially schematic and partially block, of a strobe circuit useful in describing the features of a strobe circuit essential to being fired synchronously with others.

In order to minimize unnecessary expenditure of energy, yet provide sufficient energy per flash at a constant frequency to meet minimum standards, the strobe circuit of FIG. 9 includes an energy limiter circuit which adjusts the amount of energy transferred to capacitor C2 responsively to changes in amplitude of the supply voltage. The energy limiter may take the form of a voltage regulator 36 connected in series with D.C.-to- D.C. oscillator 34 across the voltage source. Alternatively, it may be a voltage regulator 36' connected between oscillator 34 and the positive terminal of capacitor C3, or a voltage regulator 36" connected from the junction of inductor L1 and resistor R2 to the negative side of the voltage source.

In order that the strobe circuit of FIG. 9 be triggered by sync control module 18, a positive potential is normally supplied to a sync trigger circuit 38 via a conductor 40 connected to the positive terminal of the voltage source (which, it will be seen is a positive output terminal of sync control module 18). This potential also normally powers the internal timer trigger 32. Each time sync control module 18 briefly interrupts this voltage, timer trigger 34 is disabled and sync trigger 38 is enabled and triggers the firing of the flash unit.

Figure 10:
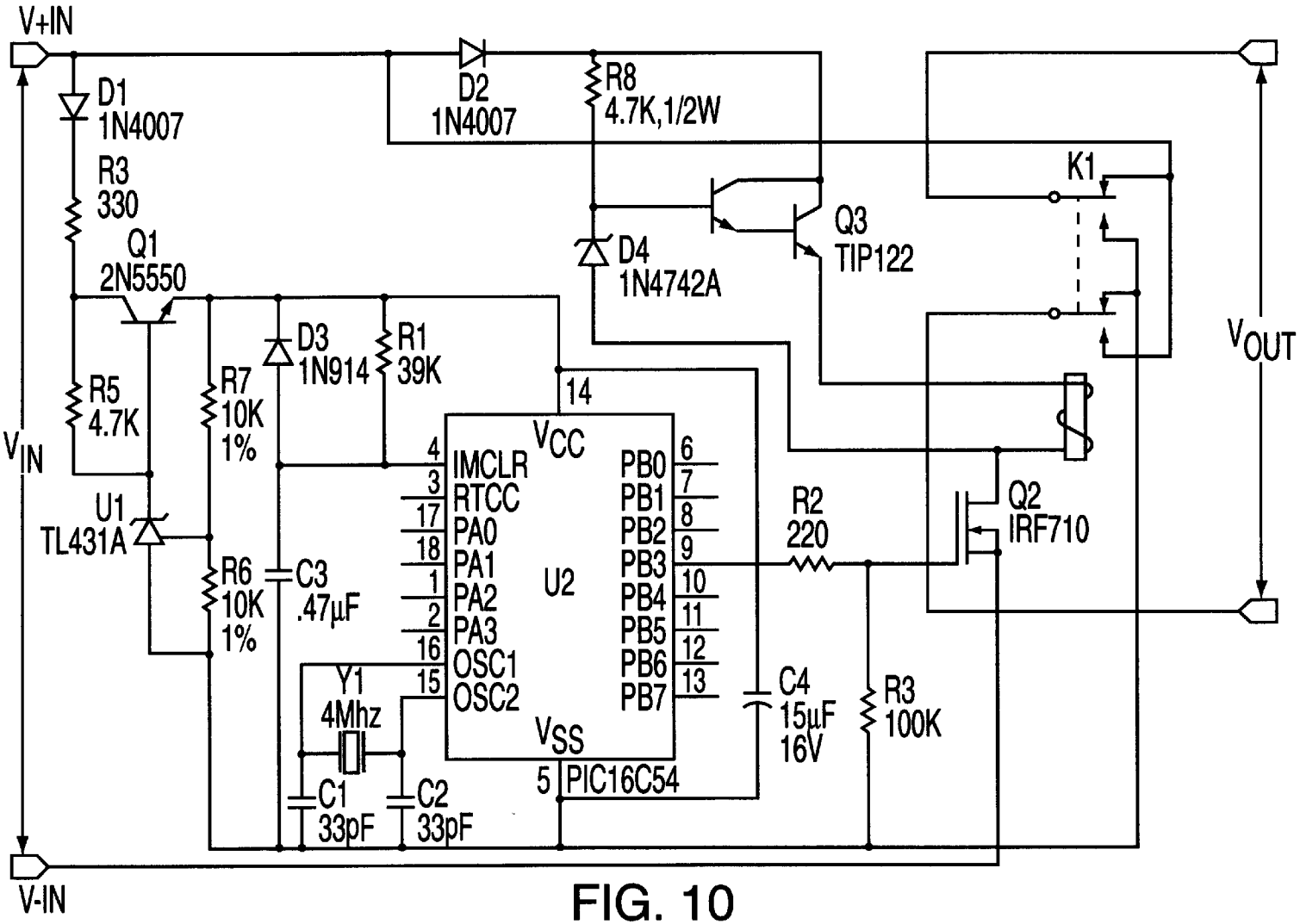
FIG. 10 is a circuit diagram of a strobe synchronizing controller according to the invention.

The preferred embodiment of the sync control circuit 18 shown in FIG. 10 is connected across a D.C. voltage source which supplies a voltage $V_{in}$. The supply voltage $V_{in}$ may have a wide range of values, from 20 volts to 31 volts, for example, in a nominally 24 volt system. The voltage is normally applied through a double pole double throw relay K1, shown in its normal position, to a pair of output terminals which supply a voltage $V_{out}$ to the input terminals of strobe units 10, 12, . . . N connected in the loop. That is to say, except when it is operating in a sync mode, the sync control circuit simply provides a direct connection from a D.C. voltage source, typically housed in the fire alarm control panel 20, to the loop connected strobes, so as to enable each of them to operate independently of the others at a flash rate determined by its internal timer.

The supply voltage $V_{in}$ is also applied through a diode D1, which typically has a voltage drop of 0.7 volt, to a regulator circuit which includes resistors R4, R5, R6 and R7, a transistor switch Q1 and an integrated circuit U1 connected as shown and having component values so as to provide a regulated 5.00±1% volt supply to the $V_{cc}$ input of a microcontroller U2. One terminal of resistor R4 is connected to the cathode of diode D1 and at the other terminal is connected to both resistor R5 and the collector of a switch Q1, which in this case is a transistor. The other terminal of resistor R5 is connected to the base electrode of switch Q1 and to an integrated circuit U1, which acts as a controlled Zener for providing a precise 5.00 volts supply. Resistor R7 is connected between the emitter of switch Q1 and the control pin of integrated circuit U1. Resistor R6 is connected at one end to both resistor R6 and the control pin of integrated circuit U1 and at the other end to one end of U1, which is connected to the negative side of the voltage source. Resistors R6 and R7 are of equal value for biasing integrated circuit U1. A reset circuit for microcontroller U2 includes a diode D3, a resistor R1 and a capacitor C3. Diode D3 and resistor R1 are connected to each other in parallel, the cathode of diode D3 being connected to the emitter of switch Q1 and its anode being connected to both the positive terminal of a capacitor C3 and the "CLEAR" input to microcontroller U2. The other terminal of capacitor C3 is connected to the negative side of the voltage source.

As noted earlier, a regulated potential of 5.00 volts is applied at $V_{cc}$ of microcontroller U2; its $V_{ss}$ terminal is connected to the negative side of the voltage source. A capacitor C4 connected across $V_{cc}$ and $V_{ss}$ acts as a filter. A resonator circuit 94 consisting of an oscillator Y1 and capacitors C1 and C2 is connected across the two oscillator inputs of, and supplies 4 MHz oscillations to, microcontroller U2. Capacitors C1 and C2 are respectively connected between the first and second oscillator inputs of the microcontroller and the negative side of the voltage source.

Before describing the function of the microcontroller U2, the components of the circuit affected thereby will be described. Connected across $V_{in}$ is a branch consisting of a diode D2, having a voltage drop of approximately 0.7 volt, a switch Q3, in this embodiment a Darlington transistor pair, the coil of relay K1 and a switch Q2, which in this embodiment is a MOSFET. The voltage applied to the base electrode of one transistor of the Darlington pair is regulated by a resistor R8 and a Zener diode D4 series-connected in that order between the cathode of diode D2 and the end of the coil of relay K1 that is connected to switch Q2.

Switch Q2 is cycled between a conducting state and a nonconducting state by an output of microcontroller U2 which is applied to the gate of switch Q2 via a voltage divider including a resistor R2 connected from the output (Pin 9) of microcontroller U2 to the gate, and a resistor R3 connected from the gate electrode to the negative side of the power source. When switch Q2 is closed, the potential at the output emitter of switch Q3 is pulled to that of the negative side of the source, causing switch Q3 to conduct and thereby cause current to flow through the coil of relay K1 and switch the relay from its normal position to the other set of contacts. Actuation of the relay reverses the polarity of $V_{out}$, which amounts to interrupting the positive D.C. voltage normally supplied to the controlled strobe units. When switch Q2 is opened, switch Q3 stops conducting, the relay is deenergized and $V_{out}$ is returned to its original polarity. By controlling the opening and closing of switch Q2, the rate at which the voltage supplied to the strobes is interrupted, and for how long, is regulated.

Figure 11:
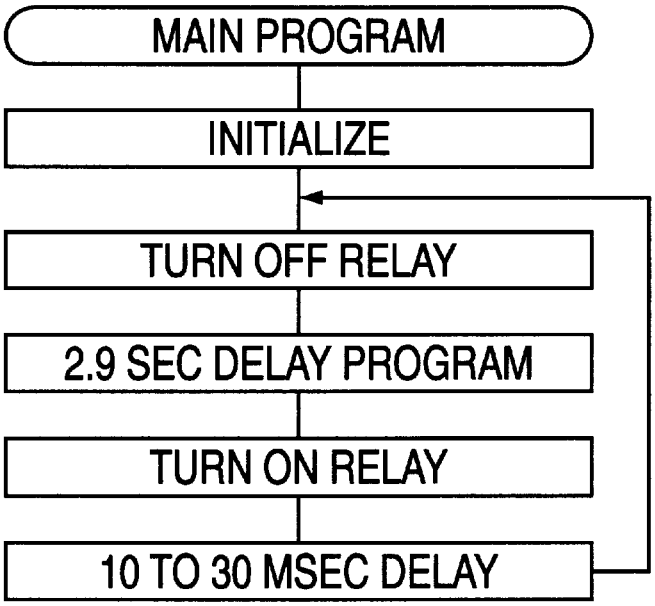
FIG. 11 is a flow chart of the functions of the strobe synchronizing controller of FIG. 10.

The real time clock and prescaler of microcontroller U2, which in this embodiment is a PIC16C71 microcontroller having 8-bit resolution, are used to produce signals for accurately controlling the ON time of switch Q2. Typically, the real time clock and prescaler routine produce pulses at Pin 9 which cause switch Q2 to be ON, and therefore interrupt power to the strobes, for a period of from 10 to 30 milliseconds, and to be OFF or open for 2.9 seconds. As illustrated by the simplified flow chart of FIG. 11, upon initialization by the main microcontroller program, switch Q2 is open and relay K1 is in the condition shown in FIG. 10. Following a delay of 2.9 seconds, the desired flash cycle of the controlled strobes, switch Q2 is closed and switch Q3 conducts and energizes relay K1 for a period of 10 to 30 milliseconds, following which the relay is again turned off and the process is repeated. If for any reason microcontroller U2 should fail to deliver a pulse to switch Q2 2.9 seconds later, the relay will remain OFF and D.C. power will be supplied to the individual controlled strobes, allowing each to operate independently under control of its internal timing trigger.

By way of example, the circuit shown in FIG. 10, when energized from a 24 volt DC power source, may use the following parameters to obtain the desired switching cycle:

| ELEMENT | VALUE OR NO. |
|---|---|
| C1, C2 | CAP., 33 pF, 200 V |
| C3 | CAP., .47 μF |
| C4 | CAP., 15 μF, 16 V |
| D1, D2 | DIODE, 1N4007 |
| D3 | DIODE, 1N914 |
| D4 | DIODE, 1N4742A |
| Q1 | TRANSISTOR, 2N5550 |
| Q2 | TRANSISTOR, IRF710 |
| Q3 | TRANSISTOR T1P122 |
| R1 | RES., 39K, 1/4W, 5% |
| R2 | RES., 220, 1/4W, 5% |
| R3 | RES., 100K, 1/4W, 5% |
| R4 | RES., 330, 1/4W, 5% |
| R5 | RES., 4.7K, 1/4W, 5% |
| R6, R7 | RES., 10K, 1/4W, 1% |
| R8 | RES., 4.7, 1/2W, 5% 4.7K |
| U1 | I.C., TL431A |
| K1 | RELAY, DPDT |

-continued

| ELEMENT | VALUE OR NO. |
|---|---|
| U2 | I.C., PIC16C54 |
| Y1 | CERAMIC RES., 4 MHZ |

As discussed earlier, sync control circuit 18 (FIG. 10) is designed to synchronize flashing of strobes of various designs, including an optocoupler strobe circuit of the type described in U.S. Pat. No. 5,121,033, provided it has the features depicted in FIG. 9. A currently preferred modification of the patented optocoupler strobe, shown in FIG. 12, differs from the patented circuit in the respects that it includes means for limiting the energy expended; a sync trigger circuit; and, a re-settable internal trigger to enable it to self-fire in the event the sync control circuit fails to deliver a sync pulse at the appropriate time. A storage capacitor C1 connected in parallel with the flashtube is incrementally charged from an inductor L1 which is connected to the positive terminal of the capacitor through a resistor R3 connected in series with a diode D2. The rate at which increments of energy are transferred from inductor L1 to capacitor C1 is determined by an optocoupler circuit which includes a resistor R2 connected in series with inductor L1. When a switch Q1 is closed and connects the inductor across the D.C. voltage source, $V_{in}$, the voltage developed across resistor R2 is indicative of the magnitude of the current flowing through inductor L1. Opening of switch Q1 is controlled by an optocoupler U1 consisting of a light-emitting diode optically coupled to a phototransistor detector. The voltage at the collector electrode of the transistor portion of the optocoupler, and at the base electrode of switch Q1, is established by a voltage divider consisting of a resistor R8 and a Zener diode Z2 connected in series across the D.C. supply, a capacitor C4 connected in parallel with diode Z2 and a resistor R1 connected from the junction of resistor R8 and diode Z2 to the aforesaid transistor collector electrode and to the base electrode of switch Q1. The diode Z2 protects switch Q1 against over-voltage and provides the regulated voltage required for the timing circuit. The capacitor C4 filters the regulated voltage, and is particularly needed when the D.C. source is a full-wave rectified supply.

As power is initially supplied to the circuit (that is, during the 2.9 seconds periods between sync signals from the sync control circuit) the LED and transistor of optocoupler U1 are both "off" and switch Q1 quickly turns "on" and connects inductor L1 across the D.C. source. Closing of switch Q1 initiates charging of the inductor L1 and a buildup of current through an isolating diode Di and resistor R2. When the current flowing through inductor L1 attains a value sufficient to develop a voltage across resistor R2 of approximately 1.2 volts, the conduction threshold voltage of the LED portion of the optocoupler, the diode is turned "on" and illuminates the transistor portion to turn it "on" which, in turn, causes switch Q1 to be turned "off" thereby to disconnect inductor L1 from across the D.C. source. During the open "off" period of switch Q1, energy stored in inductor L1 is transferred through resistor R3 and diode D2 to capacitor C1. Upon cessation of current flow through resistor R2 due to opening of switch Q1, the voltage drop across resistor R2 is no longer sufficient to keep the LED "on", the transistor stops conducting, switch Q1 is again turned "on" and the cycle is repeated.

The "on" and "off" periods of switch Q1 are determined by the switching characteristics of optocoupler U1, the values of resistors R1, R2, R8 and Zener diode Z2, the values of inductor L1 and the voltage of the D.C. source, and may be designed to cycle at a frequency in the range from about 3000 Hz to about 30,000 Hz. The repetitive opening and closing of switch Q1 eventually charges capacitor C1 to the point at which the voltage across it attains a threshold value required to fire the flashtube. Overcharging of capacitor C1 by a higher than designed source voltage is prevented by a resistor R5 and a Zener diode Z1 connected in series between the base electrode of the optocoupler transistor and the positive electrode of storage capacitor 12. The values of these components are chosen so that when the voltage across capacitor C1 attains the firing threshold voltage of the flashtube, a positive potential is applied to the base electrode of the optocoupler transistor and turns "on" the transistor which, in turn, turns switch Q1 "off" and disconnects inductor L1 from across the D.C. source.

The timer trigger circuit of the flash unit includes a resistor R4 connected in series with the combination of a switch Q3, which is this embodiment is an SCR, connected in parallel with the series combination of a capacitor C2 and the primary winding of an autotransformer T1, the secondary winding of which is connected to the trigger band of the flashtube. When the voltage across the flashtube exceeds its threshold firing voltage, switch Q3 conducts and the charge on capacitor C2 flows through the primary of transformer T1, inducing a high voltage pulse in its secondary and causing the flashtube to conduct. As previously mentioned, the flashtube quickly discharges the energy stored in capacitor C1, readying it to be recharged from the inductor L1 through diode D2.

Figure 12:
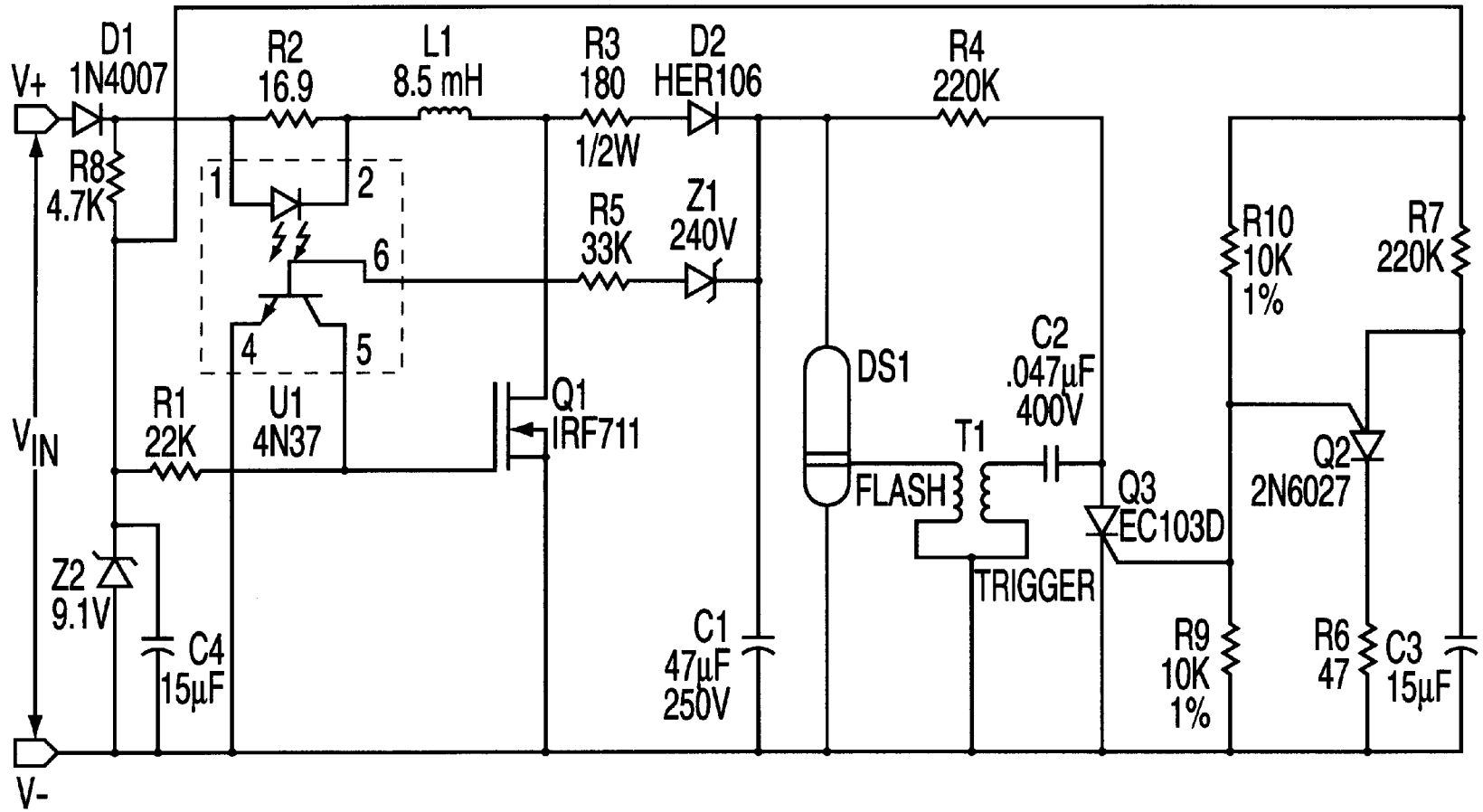
FIG. 12 is a circuit diagram of a first embodiment an optocoupler strobe useful in the system of FIG. 8.

The strobe circuit of FIG. 12 is triggered by the sync control module 18, to the exclusion of the just-described timer trigger, by a sync trigger circuit which includes a resistor R7 and a capacitor C3 connected in series in that order between the junction of resistor R8 and diode Z2 and the negative side of the power source. A switch Q2, which in this embodiment is a programmable unijunction transistor, is connected in series with a resistor R6 across capacitor C3, and a voltage divider consisting of series-connected resistors R9 and R10 is connected in parallel with the series combination of resistor R7 and capacitor C3. The junction of resistors R9 and R10 is connected to the gate electrode of the PUT, and the positive terminal of resistor R6 is connected to the gate electrode of the SCR Q3.

When the regulated voltage supplied to the sync trigger circuit is interrupted by operation of sync control module 18, the previously charged capacitor C3 discharges through resistor R7, and when the voltage on capacitor C3 reaches a predetermined level as determined by the characteristics of switch Q2 and the resistance values of resistors R9 and R10, switch Q2 is turned "on" which, in turn, turns SCR Q3 "on" to fire the flashtube. Shortly after the flashtube fires, the short interruption period of the applied potential terminates, and a positive potential is again applied to diode D1thereby to ready the circuit for arrival of the next sync pulse. In this embodiment, resistors R9 and R10 are external to switch Q2, enabling better tolerance control over their values than when these resistors are internal to switch Q2 as is the case in the modified circuit shown in FIG. 13, which in all other respects is identical to the circuit of FIG. 12. In the FIG. 13 switch Q2 is not a PUT but, instead, is a unijunction transistor having two internal resistors corresponding to resistors R9 and R10. Thus, the modification shown in FIG. 13 has two fewer parts then the FIG. 12 circuit, at the possible expense of less tolerance control.

Figure 13:
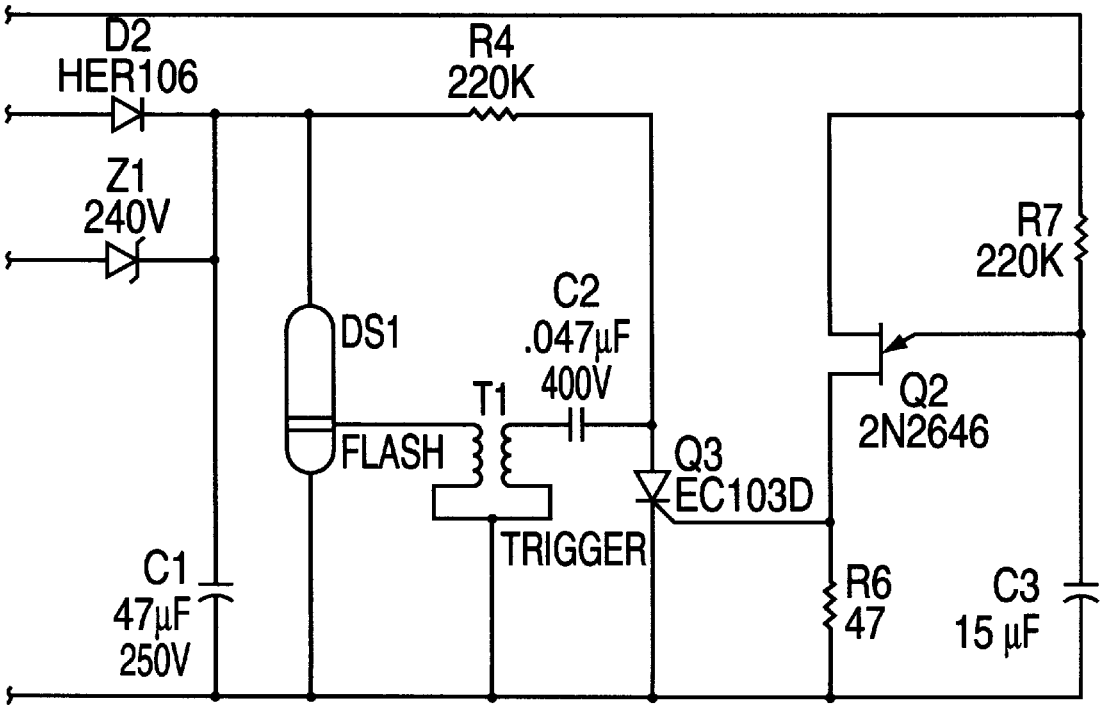
FIG. 13 is a diagram which illustrates a modification of the circuit of FIG. 12.

By way of example, the circuit illustrated in FIG. 12, and the modification thereof shown in FIG. 13, when energized from a 24 volt D.C. power source, may use the following parameters for the circuit elements:

| ELEMENTS | VALUE OR NO. |
|---|---|
| C1 | CAP., 47 μF, 250 V |
| C2 | CAP., .047 μF, 400 V |
| C3 | CAP., 15 μF, 5% |
| C4 | CAP., 15 μF, 5% |
| D1 | DIODE, 1N4007 |
| D2 | DIODE, HER106 |
| L1 | INDUCTOR, 8.5 mH |
| Z1 | DIODE, 240 V. |
| Z2 | DIODE, 9.1 V., 5% |
| Q1 | TRANSISTOR, IRF710 |
| Q2 | PUT 2N6027 (FIG. 12); UJT 2N2646 (FIG. 13) |
| T1 | TRIGGER TRANSFORMER |
| DS1 | FLASHTUBE |
| Q3 | SCR, EC103D |
| R1 | RES., 22K, 1/4W |
| R2 | RES., 16.9 |
| R3 | RES, 180, 1/2W |
| R4 | RES., 220K |
| R5 | RES., 33K |
| R6 | RES., 47 |
| R7 | RES., 220K |
| R8 | RES., 4.7K |
| R9, R10 | RES., 10K, 1% |
| U1 | OPTOCOUPLER, 4N37 |

Figure 14:
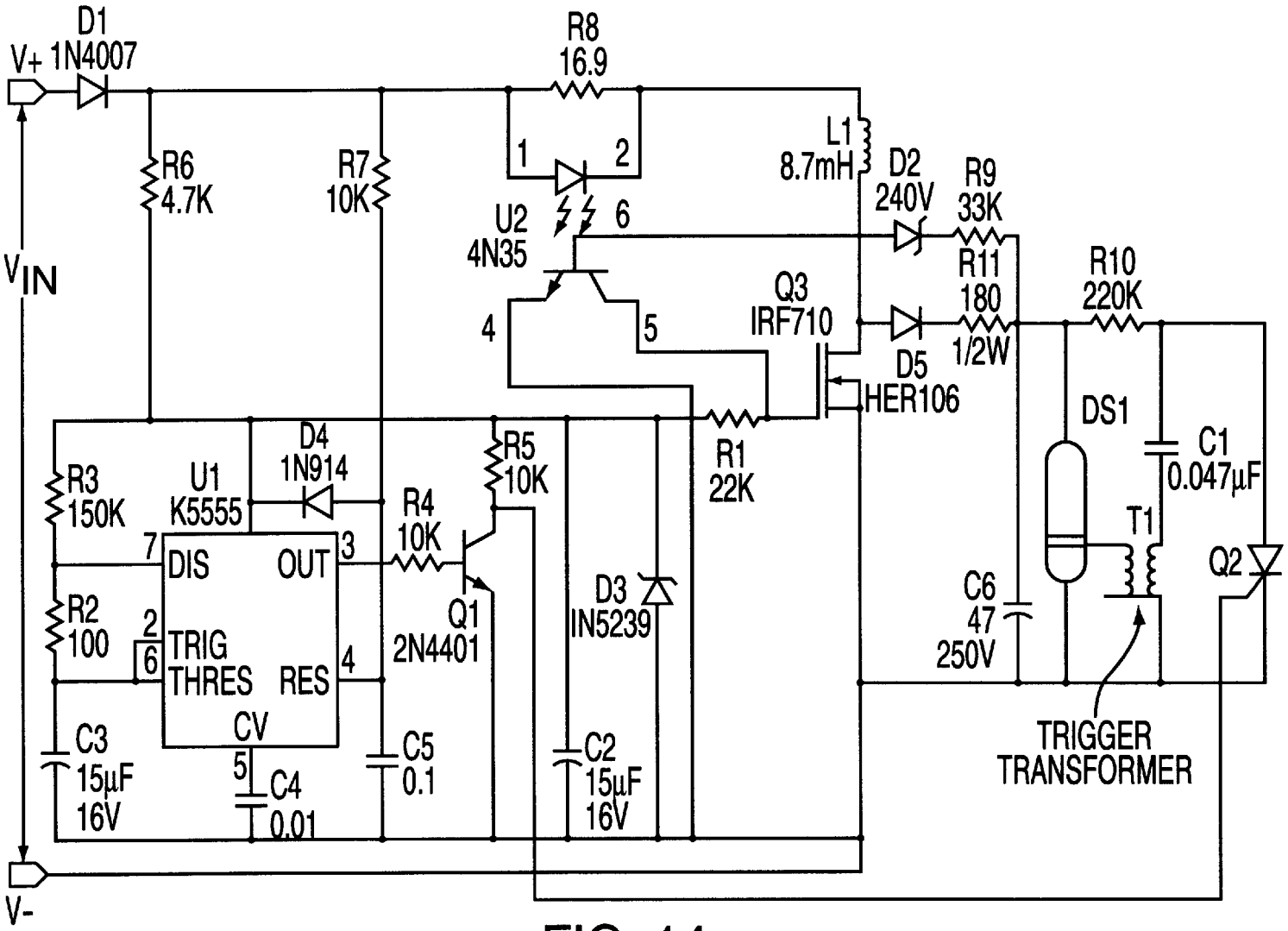
FIG. 14 is a circuit diagram of a third embodiment of an optocoupler strobe circuit wherein flashing of the strobe is controlled by a timer.

FIG. 14 is a circuit diagram of another strobe circuit utilizing an optocoupler for D.C.-to-D.C. conversion in which a combination of a CMOS timer and an SCR is used to control firing and triggering of the flashtube in both the synchronous and non-synchronous modes of operation. Briefly, a capacitor C6 connected in parallel with the flashtube is incrementally charged through a diode D5 and a resistor R11 from an inductor L1, which is cyclically connected and disconnected across a D.C. supply by a switch Q3 controlled by an optocoupler U2. A Zener diode D2 and a resistor R9 series-connected between the base electrode of the transistor of the optocoupler and the positive terminal of capacitor C6 shuts off the D.C./D.C. oscillator when the capacitor is charged to maximum capacity, thereby limiting the energy supplied to the flashtube to only what is necessary. The trigger circuit for the flashtube includes a resistor R10 connected in series with the combination of a switch Q2, which in this embodiment is an SCR, connected in parallel with the series combination of a capacitor C1 and the primary winding of an autotransformer T1, the secondary of which is connected to the trigger band of the flashtube. When switch Q2 is turned "on" in a manner to be described presently, capacitor C1 discharges through the primary of transformer T1 and induces a high voltage in the secondary winding which, if the voltage on capacitor C6 equals the threshold firing voltage of the tube, causes the flashtube to conduct and quickly discharge capacitor C6.

In this embodiment, switch Q2 is turned "on" in both the synchronous and self-timed modes of operation by an integrated circuit timer U1 which, in this embodiment is a KS555 timer. The KS555 is a stable timer capable of producing accurate time delays or frequencies, which for stable operation as an oscillator, as here used, the free-running frequency and the duty cycle are both accurately controlled by two resistors R3 and R2 and a capacitor C3 connected in series in that order between the junction of a resistor R6 connected in series with a Zener diode D3 and the negative side of the D.C. supply. The Zener D3 regulates the voltage applied to the V.sub.cc terminal of the timer and to the junction between resistors R6 and R3. The "THRES"

and "TRIG" terminals of the timer are connected to the junction between resistor R2 and capacitor C3 and the DISCHARGE terminal is connected to the junction of resistors R3 and R2. The RESET terminal is connected to the junction between a resistor R7 and a capacitor C5 connected in series across the D.C. supply, and the OUTPUT terminal is connected to the base electrode of a switch Q1, which in this embodiment is a transistor. The junction between resistor R7 and capacitor C5 is also connected via a diode D4 to the V.sub.cc terminal.

In this embodiment, resistors R2 and R3 have resistance values of 100 ohms and 150 K ohms, respectively, and capacitor C3 has a value of 15 $\mu$F. When operating in the non-synchronous (i.e., self-timed) mode, capacitor C3 is charged through resistors R3 and R2 until it has charged to ⅔ V of the Zener voltage of diode D3. During charging, the "OUT" Pin 3 of the timer is high, causing transistor Q1 to conduct which, in turn, by reason of a connection from its collector electrode to the gate electrode of SCR Q2, turns the latter "Off". Once capacitor C3 has charged to ⅔ V, the voltage at Pin 7 causes Pin 3 to go low, which initiates a discharge cycle. Capacitor C3 discharges through resistor R2 only until its voltage reaches ⅓ of the voltage on D3, which because of the small resistance of R2 occurs in a very brief time period. During this brief period, switch Q1 is turned "off" and applies a pulse to switch Q2 to turn it "on" and the flashtube is fired. The timer provides greater control over the flash rate in the non-synchronous mode than does the circuit shown in FIG. 12, potentially at less than 3 seconds intervals.

When operating in the synchronous mode, the timer U2 is in its charging or "on" state; when a sync pulse arrives the D.C. power is interrupted by Pin 4 (RESET) of the timer being pulled to ground through the action of the series-connected resistor R7 and capacitor C5, the potential at the junction of which is coupled to Pin 4 (RESET) and also through diode D4 to the $V_{cc}$ terminal of the timer. Grounding of Pin 4 resets the timer, turning switch Q1 "off" which, in turn, turns switch Q2 "on" to fire the flashtube. Upon termination of the sync signal, which it will be recalled has a period in the range from 10 to 30 milliseconds, capacitor C3 is again charged through resistors R6, R3 and R2 to ready the timer for arrival of the next sync signal. In case a sync signal does not arrive 2.9 seconds later the timer will automatically go into the described non-synchronous self-timed mode.

By way of example, the following parameters may be used for the components of the FIG. 14 circuit, having a $V_{in}$ of 24 V D.C., to obtain the indicated flash frequencies:

| ELEMENT | VALUE OR NO. |
|---|---|
| C1 | CAP., 0.047 $\mu$F, 400 V |
| C2, C3 | CAP., 15 $\mu$F, 16 V |
| C4 | CAP., 0.01, $\mu$F |
| C5 | CAP., 0.1 $\mu$F |
| C6 | CAP., 47 $\mu$F, 250 V |
| D1 | DIODE, 1N4007 |
| D2 | ZENER DIODE, 240 V |
| D3 | ZENER DIODE, 1N5239 |
| D4 | DIODE, 1N914 |
| D5 | DIODE, HER106 |
| Q1 | TRANSISTOR, 2N4401 |
| Q2 | SCR, ? |
| Q3 | TRANSISTOR, IRF710 |
| L1 | INDUCTOR, 8.7 mH |
| R1 | RES., 22k |
| R2 | RES., 100 |

-continued

| ELEMENT | VALUE OR NO. |
|---|---|
| R3 | RES., 150K |
| R4, R5 | RES., 10K |
| R6 | RES., 4.7K |
| R7 | RES., 10K |
| R8 | RES., 16.9 |
| R9 | RES., 33K |
| R10 | RES., 220K, 1/2W |
| R11 | RES., 180, 1/2W |
| U1 | TIMER, KS555 |
| U2 | OPTOCOUPLER, 4N35 |

Figure 15:
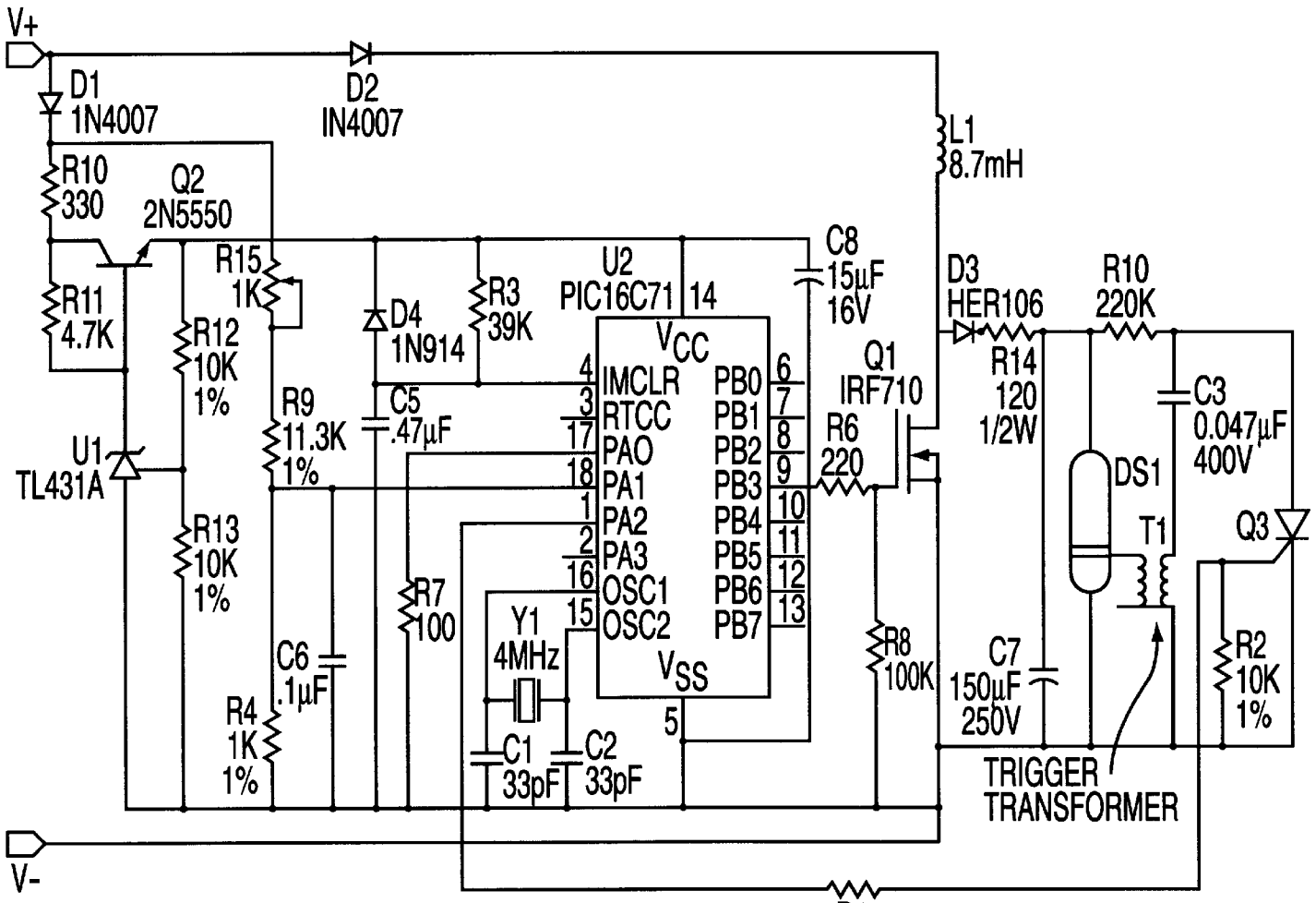
FIG. 15 is a circuit diagram of a microprocessor-controlled strobe useful in the system of FIG. 8.

FIG. 15 is a circuit diagram of a microcontroller strobe circuit similar to that disclosed and claimed in applicants' copending application Ser. No. 08/061,965 filed May 14, 1993, the flashing of which also may be synchronized by the sync control circuit 18 of FIG. 10. The circuit is connected across the D.C. voltage source, supplied via the sync control circuit 18 as previously described, having a voltage $V_{in}$. The voltage is applied through a diode D1, which typically has a voltage drop of 0.7 volt, to a regulator which includes resistors R10, R11, R12 and R13, a switch Q2 and an integrated circuit U1 for providing a regulated 5.00±1% volts input to the $V_{cc}$ terminal of a microcontroller U2. A precise $V_{cc}$ input voltage is vital for the analog-to-digital reference input of microcontroller U2. Resistors R10 and R11 are connected in series between the cathode of diode D1 and the base electrode of switch Q1, which in this case is a transistor, and also to the cathode of integrated circuit U1, which acts as a controlled Zener for providing 5.00 volts±1%. Resistors R12 and R13 are connected in series between the emitter of transistor Q2 and the negative side of the voltage source, and their junction is connected to the control electrode of integrated circuit U1. Resistors R12 and R13 are of equal value for biasing integrated circuit U1.

A reset circuit includes a diode D4, and a capacitor C5 connected in series between the emitter electrode of switch Q2 and the negative side of the D.C. source, and a resistor R3 connected in parallel with diode D4. The junction between diode D4 and capacitor C5 is connected to the "CLEAR" terminal of microcontroller U2. As stated above, microcontroller U2 is supplied with a regulated 5 volt supply at V.sub.cc; the V.sub.ss terminal is connected to the negative side of the source. A capacitor C8 connected across V.sub.cc and V.sub.ss acts as a filter. A resistor R7 connected between one of the analog-to-digital input terminals (PAO, Pin 17) of microcontroller U2 and the negative side of the source acts as a shield for the controller. Oscillations at a frequency of 4 MHz are applied to terminals OSC1 and OSC2 of the microcontroller by a resonator circuit consisting of an oscillator Y1 and a pair of capacitors C1 and C2 connected between the negative side of the source and the first and second oscillator inputs, respectively.

A voltage level proportional to the supply voltage, V.sub.in, is supplied to a different analog-to-digital input terminal of the microcontroller, for example, the PA1 terminal (Pin 18) by a voltage divider network consisting of a potentiometer R15, a resistor R9 and a resistor R4 connected in series between the junction of diode D1 and resistor R10 and the negative side of the D.C. source, and a capacitor C6 connected in parallel with resistor R4. The voltage developed at the junction between resistors R9 and R4, which may be fine-tuned by the potentiometer R15, is applied to the PA1 terminal.

The microcontroller U2 controls the opening and closing of a switch Q1, which in this embodiment is a MOSFET, by coupling a signal developed at an output terminal PB3 (Pin 9) via a voltage divider consisting of resistors R6 and R8 to the gate electrode of switch Q1. Switch Q1 is connected in series with an inductor L1 and a diode D2, and when closed connects the inductor across the voltage source, V.sub.in. With switch Q1 closed, inductor L1 stores energy until a steady state level is reached, or the switch is opened. When switch Q1 is opened, the energy stored in inductor L1 is at least partially transferred through a diode D3 and a resistor R14 to a storage capacitor C7 connected in parallel with a flashtube. By controlling the opening and closing of switch Q1, the rate at which energy is stored in inductor L1 is regulated, thereby regulating the energy transferred to storage capacitor C7. Diode D3 permits current flow into the flash unit but prevents discharge of capacitor C7 when the potential across it is higher than V.sub.in or the potential across inductor L1. The flashtube is shunted by a trigger circuit which includes a resistor R1 connected in series with the combination of a switch Q3, which in this embodiment is an SCR, connected in parallel with the series combination of a capacitor C3 and the primary winding of an autotransformer, the secondary winding of which is connected to the trigger band of the flashtube. When, at the appropriate time, a signal produced at the PA2 output of microcontroller U2 is applied via a resistor R5 to the gate of the SCR (Q3), the SCR is fired and causes capacitor C3 to discharge through the primary winding of the transformer, inducing a high voltage pulse in the secondary winding which ionizes the gas in the flashtube and causes it to flash, provided the voltage thereacross equals or exceeds the threshold firing voltage. A resistor R2 connected between the gate electrode of the SCR and the negative side of the D.C. supply isolates the SCR from noise.

Microcontroller U2, which in this embodiment is a PIC16C71 microcontroller having a built-in analog-to-digital converter with 8-bit resolution, uses the A/D converter to arrive at a digital equivalent of the supply voltage and then uses this digitized information to control the opening and closing of switch Q1, and thus the charging of inductor L1 and the transfer of energy from the inductor to capacitor C7, so that the output PA2 triggers switch Q3 to fire the flashtube at the same time that the potential across the capacitor C7 has attained the desired value. More particularly, the A/D converter measures the supply voltage in 256 steps of approximately ¼ volt each. The microcontroller program U2 equates each step with a location in a look up table. One conversion or measurement is made for each cycle of the switch Q1, a new value being read from the lookup table each time. These values control the ON time of switch Q2. The ON time for each value in the lookup table is empirically derived; for low voltages, the ON time is long, and for high voltages, the ON time is shorter, whereby the energy stored throughout a flash cycle is kept somewhat constant.

The switching frequency of switch Q1 is in the range of approximately 3 kHz to 30 kHz and has a high duty cycle (roughly 50% to 90%). Each value in the lookup table equates to a switching frequency for ensuring that switch Q2 will be ON for sufficient time to charge capacitor C7 to the precise amount needed for the minimum required intensity of once per three seconds flash, for example. The high duty cycle results in storing of the energy in inductor L1 for most of the three seconds interval between flashes. This means that peak currents are lower than if the routine utilized a low duty cycle in which inductor L1 was charged for a relatively shorter period during each flash cycle.

If the supply voltage sensed is below a minimum (e.g., less than 13 volts, below which it may be impossible to obtain the precise 5.00 volts.+–.1%) microcontroller U2 turns switch Q1 OFF and waits for the level to rise above the preset start up voltage (e.g., 14 volts).

Microcontroller U2 has an interrupt, a real time clock and a prescaler which are used to produce an accurate, one per three seconds flash rate. The real time clock and prescaler generate a one-fifteenth of a second interrupt. The interrupt service routine then counts these pulses. When fifteen pulses have occurred, a pulse is sent to the SCR Q3 and the flashtube is triggered. The interrupt routine additionally controls the variable OFF time function. The OFF time of switch Q1 is programmed to be a different predetermined value dependent on the number of cycles completed in the fifteen hertz rate of the interrupt (i.e., dependent on the time since the last flash). A high value of OFF time is used after a trigger event, followed by several progressively lower values. This helps to minimize current anomalies during and immediately after a flash.

By way of example, the following parameters may be used for the elements of the FIG. 15 circuit to obtain a flash frequency of one flash per three seconds:

| ELEMENT | VALUE OR NO. |
|---|---|
| C1, C2 | CAP., 33 pF, 200 V |
| C3 | CAP., .047 .mu.F, 400 V |
| C5 | CAP., .47 .mu.F |
| C6 | CAP., 1 .mu.F |
| C7 | CAP., 150 .mu.F, 250 V. |
| C8 | CAP., 15 .mu.F, 16 V |
| D1, D2 | DIODE, 1N4007 |
| D3 | DIODE HER106 |
| D4 | DIODE 1N914 |
| L1 | INDUCTOR, 8.7 mH |
| Q1 | TRANSISTOR, IRF740 |
| Q2 | TRANSISTOR, 2N5550 |
| Q3 | SCR, EC103D |
| R1 | RES., 220K |
| R2 | RES., 10K |
| R3 | RES., 39K |
| R4, R5 | RES. 1K |
| R6 | RES., 220 |
| R7 | RES., 100 |
| R8 | RES., 100K |
| R9, | RES., 11.3K |
| R10 | RES., 330 |
| R11 | RES., 4.7K |
| R12, R13 | RES., 10K |
| R14 | RES., 120 |
| R15 | POT., 1K |
| T1 | TRANSFORMER, TRIGGER |
| U1 | I.C., TL431A |
| U2 | I.C., PIC16C71 |
| Y1 | CERAMIC RES., 4 MHz |

Figure 16A:
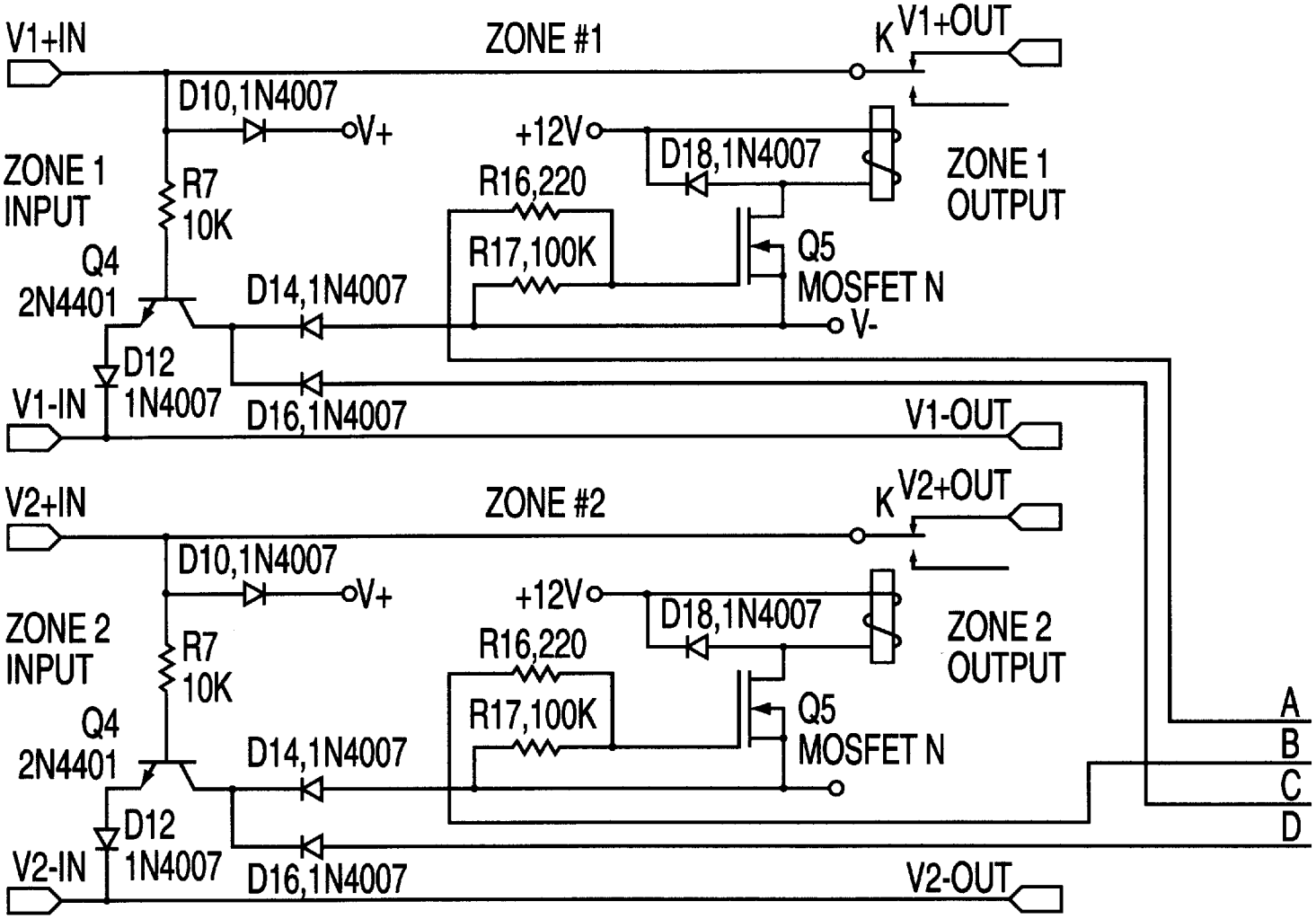
FIGS. 16 and 17, when placed together as shown in FIG. 18, is a circuit diagram of a 4-channel strobe synchronizing controller according to the invention.
Figure 16B:
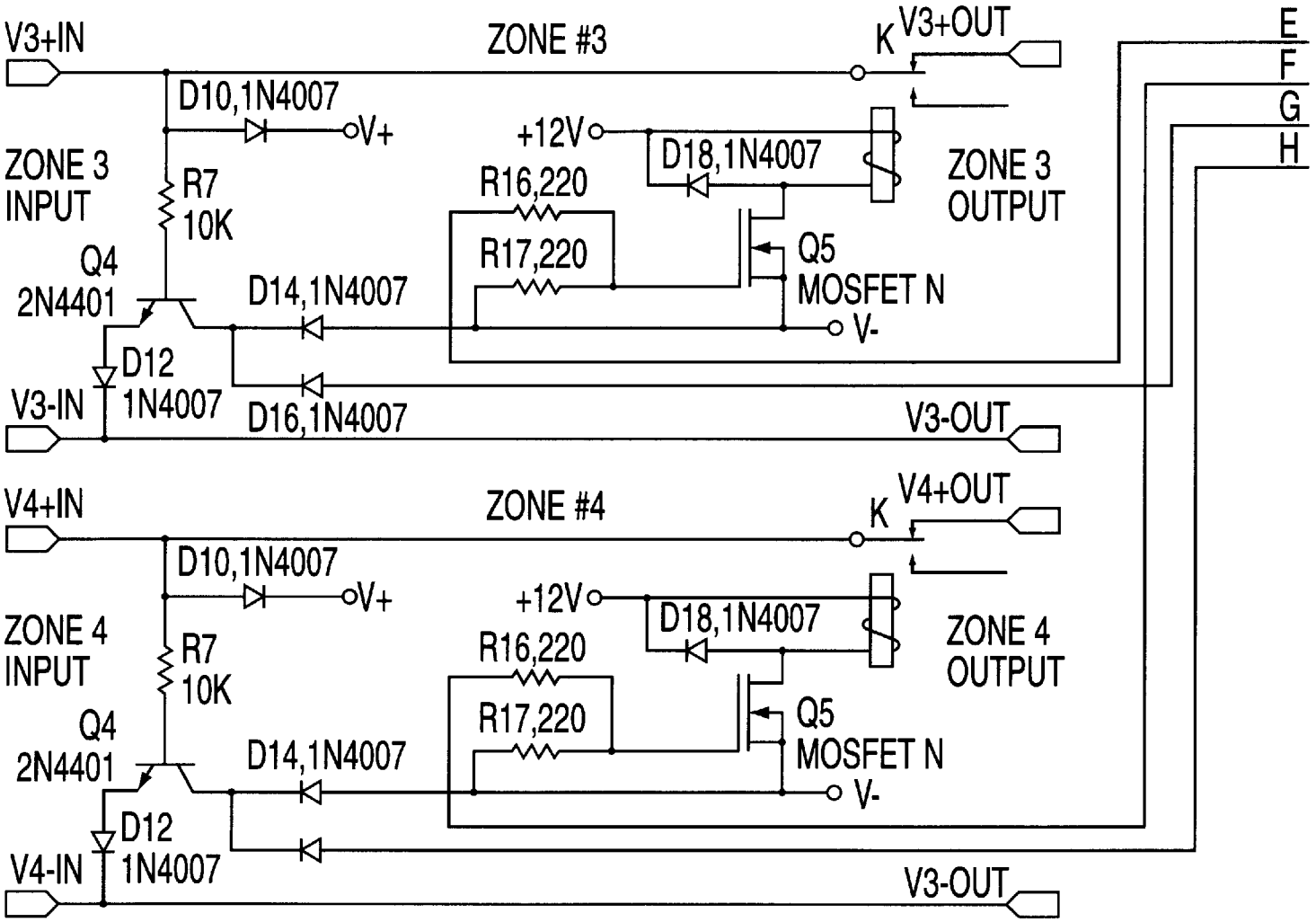
Figure 17A:
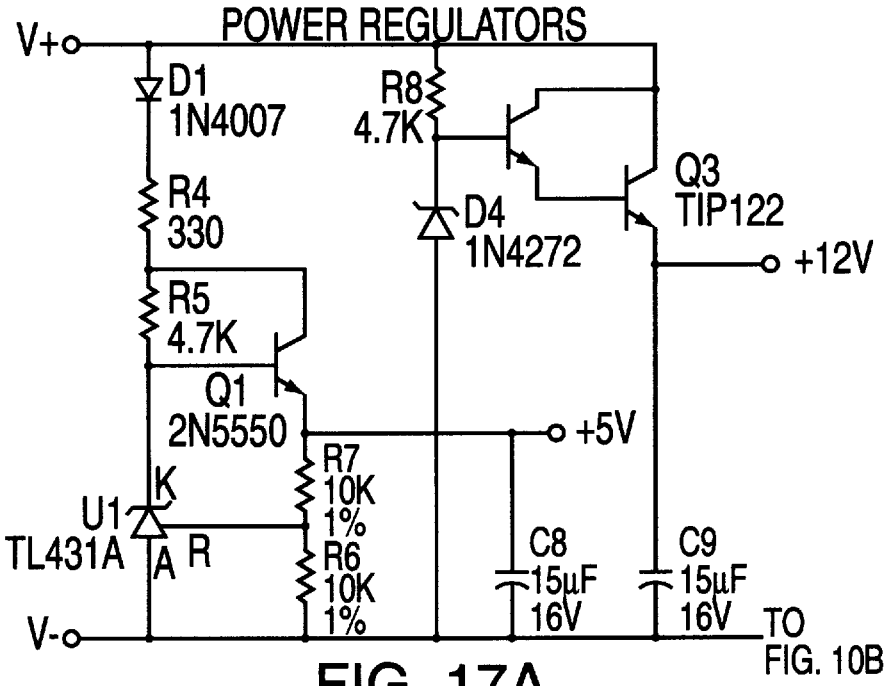
Figure 18:
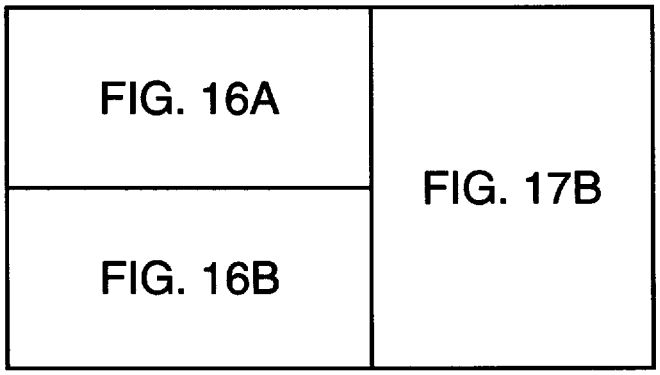
FIG. 18 is a diagram showing the arrangement of FIGS. 16 and 17.
Figure 17B:
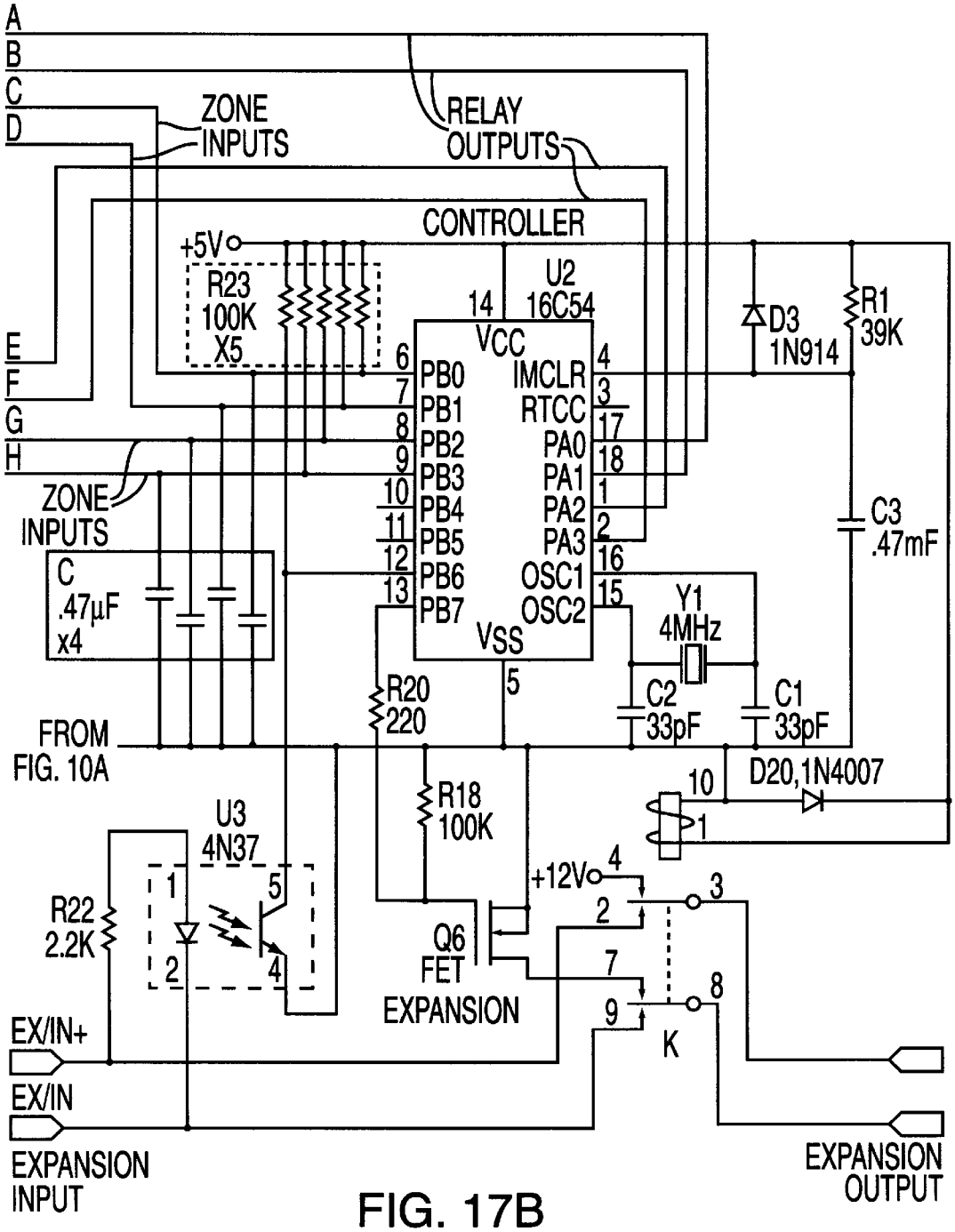

While up to this point the invention has been described in association with a fire alarm system including a fire alarm control panel which controls multiple strobes connected in a single loop, conventional fire alarm control panels may, and often do, control more than one loop of multiple strobes. The several loops may, for example, be installed in different zones or sections of a building, in which case it would not be necessary to synchronize flashing of the strobes in all of the loops, but in other situations it may be desirable to synchronize flashing in one or more of loops presenting an alarm condition. The control unit illustrated in FIG. 10 could not by itself perform these functions, yet in the interest of cost it is desirable to avoid having to provide a separate controller for each of the loops. The control circuit shown in FIGS. 16 and 17 enables one microcontroller to control up to four separate loops or zones, and may be expanded to control one or more additional controllers each capable of controlling an additional four loops of strobes. Referring to FIGS. 16 and 17, in which components common to FIG. 10 are correspondingly identified, a single microcontroller U2, which may be a PIC16C54, is capable of controlling up to four loops of strobes (not shown) which are connected to the positive and negative OUTPUT terminals of four relay circuits labeled ZONE 1, ZONE 2, ZONE 3 and ZONE 4, respectively. When and only when an alarm condition is present in a zone, a D.C. voltage, typically 24 volts, is applied across its positive and negative INPUT terminals, and a relay K connected to the positive terminal when in the condition shown in FIG. 16, supplies this voltage to the strobes connected in a loop to that zone. As will be described presently, the microcontroller U2 produces signals at its output pins 6, 7, 8 and 9 which are applied to control circuitry in ZONES 1, 2, 3 and 4, respectively, which momentarily open a corresponding relay K, for a period of 10–30 milliseconds, thereby interrupting power to and triggering flashing of the strobes powered through that relay.

Referring in detail to FIG. 16 and the ZONE 1 circuitry, the positive side of the D.C. input voltage is coupled through a diode D10 to a terminal labeled "V+" and a negative side is coupled through a diode D12, the emitter-collector path of a bipolar NPN transistor Q4 and a diode D14 to a terminal labeled "V−". A potential exists between these V+ and V− terminal only when a D.C. potential, V.sub.in, is applied to the ZONE 1 input terminals. The same is true of the ZONE 2, ZONE 3 and ZONE 4 circuits, namely, that a potential appears across their V+ and V− terminals when, and only when, a D.C. potential indicating an alarm condition is applied to their input terminals. The terminals labeled "V+" in all four zones are actually internally connected together and to a similarly labeled terminal of a power regulator circuit (FIG. 17) and the terminals labeled "V−" in all four zones are internally connected together and to the negative side of the power regulator circuit. Thus, a potential is applied across the "V+" and "V−" terminals of the power regulator only if one or more of the four zones is energized.

To enable the microcontroller to determine which of the four zones is energized, particularly when more than one are energized at the same time, each is isolated from the others by an isolation circuit including the aforementioned diodes D10, D12, D14 and transistor Q4 and a resistor R15 connected between the positive side of the D.C. input voltage and the base electrode of transistor Q4. Diode D10 is a blocking diode which prevents current flow from the commonly-connected "V+" terminals to other zones and also prevents current from such common circuit from forward-biasing transistor Q4 when a zone, say ZONE 1, is energized. The negative side of the input D.C. is coupled via diode D12, transistor Q4 and another diode D16 onto a respective ZONE INPUT line to a respective one of four inputs to microcontroller U2 labeled PB0, PB1, PB2 and PB3, respectively. Each of these ZONE INPUT lines is connected via a respective resistor R to a regulated +5.00 volts supply (to be described) and via a respective capacitor C to the negative side of the supply.

Regulated voltages for operating the system are supplied by the POWER REGULATORS shown in FIG. 17 when, and only when, one or more of the zones are actuated so as to provide a potential, typically 24 volts, between the internally connected terminals labeled "V+" and "V−". A voltage of 5.0 volts .+−.1% is produced at an output terminal labeled "+5 V" by a regulator which includes a diode D1, resistors R4 and R5 and an integrated circuit U1 which acts as a controlled Zener, connected in series in that order from the V+ terminal to the V− terminal of the supply, a transistor Q1 having its base electrode connected to the junction of resistor R5 and integrated circuit U1, its collector connected to the junction of resistors R4 and R5, and its emitter connected through series-connected resistors R7 and R6 to the V− terminal of the power supply. The junction of resistors R6 and R7 is connected to the control pin of integrated circuit U1. A regulated potential of 5.0 volts produced at the emitter of transistor Q1 is filtered by a capacitor C8, and applied via an internally connected terminal, also labeled "+5 V" to the V.sub.cc input of the microcontroller. The V.sub.ss input of the controller is connected to the V− terminal of the power supply.

A regulator for producing a potential of 12 volts required for operation of ZONE and EXPANSION relays includes a resistor R8 and a Zener diode D4 connected in series across the supply, and a Darlington transistor pair Q3 connected in parallel with resistor R8 and in series with a filter capacitor C9. The regulated 12 volts produced at the output emitter of the Darlington pair appears at a terminal labeled "+12 V" which is internally connected to a similarly labeled terminal in each of the ZONE circuits and also in the EXPANSION circuit. It is again emphasized that the controller is powered only when at least one ZONE is energized.

The clock frequency of the microcontroller is determined by a 4 MHz resonator Y1 and a pair of capacitors C1 and C2 connected to the OSC1 and OSC2 terminals, respectively, of the controller. When energized upon the occurrence of an alarm condition in a ZONE, the microcontroller is programmed to monitor the ZONE INPUTS and ascertain which of them is activated, and then toggles a relay K in the circuitry for the corresponding ZONE for a period in the range from 10 to 30 milliseconds, thereby briefly interrupting the application flow of power to the strobes associated with that ZONE.

More particularly, and assuming that the microcontroller has sensed that ZONE 1 has been energized, after a delay of 2.9 seconds following initial sensing of the alarm condition, a +5.00 volts signal is produced at output terminal PA0 (Pin 17) and coupled via a respective RELAY OUTPUT line to the gate electrode of a MOSFET Q5 via a voltage divider including resistors R16 and R17 connected in series and to the terminal "V−". The junction of resistors R16 and R17 is connected to the gate electrode of Q5, the source and drain electrodes of which are connected in series with the coil of relay K across the power supply represented by terminals "V+" and "V−". When switch Q5 is turned "ON" by the signal from Pin 17, relay K is activated, thereby interrupting power flow to the strobes for a short, hardly noticeable, interval. An optional diode D18 connected across the relay coil suppresses the reverse EMF spike that is generated when switch Q5 is opened, but may be omitted in the interest of increasing the switching speed of the relay.

If, for example, the controller also senses an alarm condition in ZONE 4, a +5.00 volts signal is also produced at output terminal PA3 (Pin 2) which turns "ON" the MOSFET and actuates the relay K in the ZONE 4 circuit in synchronism with actuation of the relay in the ZONE 1 circuit, whereby the strobes in the loops associated with both zones will be fired at the same time. Alternatively, to preclude the creation of possible anomalies in current flow that might result from all strobes in the four loops flashing at the same time, the microcontroller may be programmed to interrupt the power in the four loops at staggered times within the 2.9 seconds interval. That is to say, the 2.9 seconds interval may be divided into four time slots of approximately 0.75 second each in which triggering of the four zones is initiated sequentially. The flashing would be harmonious, if not synchronous, but would meet Underwriters Laboratories' specifications for flash rates.

Figure 20:
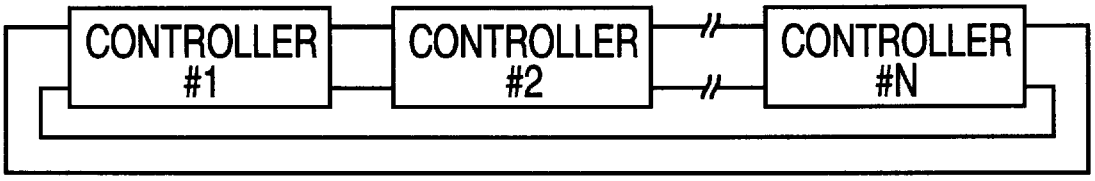
FIG. 20 is a simplified block diagram showing the interconnection of a plurality of a 4-channel controllers of the kind illustrated in FIGS. 16 and 17.

In accordance with another aspect of the invention, synchronized firing of the strobes in more than four loops can be controlled by providing the controller with an EXPANSION circuit having EXPANSION INPUT and EXPANSION OUTPUT terminals, as shown in the lower right-hand portion of FIG. 17, which are connected in "daisy-chain" fashion as depicted in FIG. 20, to the EXPANSION INPUT and EXPANSION OUTPUT terminals of one or more similarly equipped controller of the kind just described, each for controlling four loops of flash units. More particularly, the expansion output terminals of a first controller, labeled "CONT. #1" are connected to the expansion input terminals of a second controller, CONT. #2, the expansion output terminals of which are connected to the expansion input terminals of a third controller, and so on, with the expansion output terminals of the last controller of the chain connected back to the expansion input terminals of the first. By connecting multiple controllers in this way, sync signals generated by one controller in the chain as a consequence of an alarm condition occurring in at least one of its associated ZONES, may be transferred to the other controllers in the chain. Because each of the interconnected controllers is equally likely to experience an alarm condition, and there is no way of knowing when, if ever, a particular controller will be energized by occurrence of an alarm condition, the EXPANSION circuit of each controller must be able to transfer sync signals from the EXPANSION INPUT terminals to the EXPANSION OUTPUT terminals whether the controller is powered or not.

To this end, the EXPANSION circuit includes a relay K, the coil of which is connected between the "+5 V" and "V−" terminals of the microcontroller and shunted by a diode D20 for suppressing the back EMF spike created when current through the coil is turned off. In the event of no power on any of the four zones, with the consequence that the microcontroller U2 is not energized, the relay contacts are in the illustrated non-energized position and accordingly by-pass the controller. That is, contact 2 and contactor 3 and contact 9 and contactor 8 respectively directly connect positive and negative EXPANSION INPUT terminals to positive and negative EXPANSION OUTPUT terminals.

However, when an alarm condition occurs in at least one ZONE to cause powering of the controller, current flows through the relay coil from the +5 V bus to the negative side of the supply and actuates the relay, whereby a +12 V potential is coupled through contact 4 and contractor 3 to the positive EXPANSION OUTPUT terminal and the drain electrode of a MOSFET Q6 is coupled through contact 7 and contactor 8 to the negative EXPANSION OUTPUT terminal, and the positive and negative EXPANSION INPUT terminals are both disconnected. As a consequence the relay K no longer by-passes the controller to transfer any sync signals generated by another controller in the chain and appearing on the EXPANSION INPUT line to the next successive controller. The by-pass function is restored by a circuit including an optocoupler U3, the light emitting diode of which is connected in series with a resistor 22 across the EXPANSION INPUT lines, and the transistor output portion of which is connected in series with a resistor R23 between the "+5 V" and "V−" terminals of the POWER REGULATORS. The junction between resistor R23 and the collector of the transistor is connected to terminal PB6 (Pin 12) of controller U2. If at least one ZONE associated within another interconnected controller is energized, there will be a 12 volt D.C. potential across the EXPANSION INPUT lines, causing the optocoupler diode to conduct and turn "on" the transistor portion. Conduction of the transistor portion pulls the potential on Pin 12 of the controller from +5 V to zero, which the controller is programmed to sense and cause terminal PB7 (Pin 13) to go "high". This voltage pulse is applied to the gate electrode MOSFET Q6 via a voltage divider including resistors R18 and R20, which turns Q6 "on" and causes current flow in the diode portion of the optocoupler connected to the EXPANSION INPUT terminals of the next controller in the chain. Thus, when the controller is powered, the "expansion" sync signal is received through the optocoupler and under control of the microcontroller is forwarded via switch Q6 to the next controller.

Figure 19:
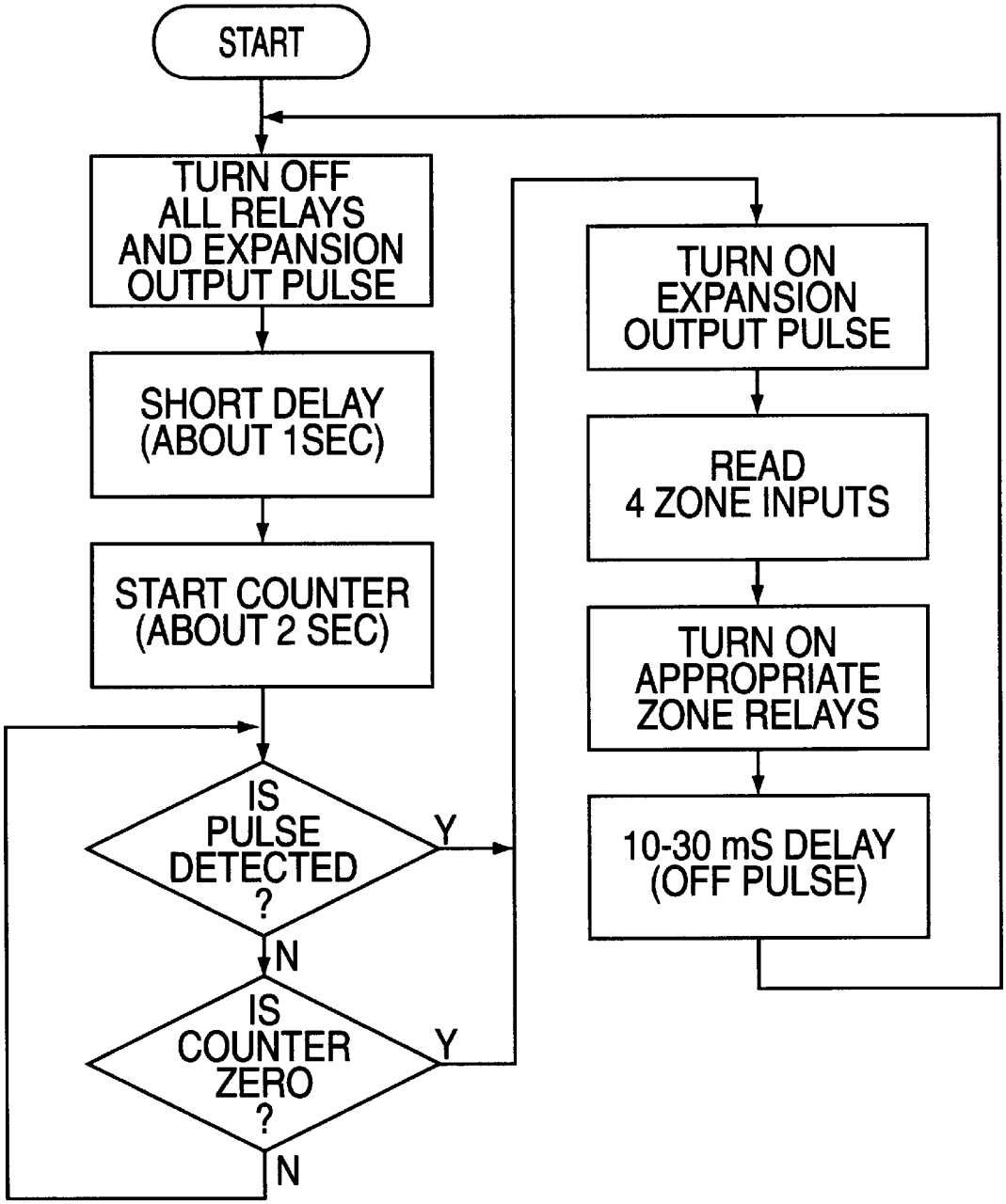
FIG. 19 is a flow chart of the functions of the strobe synchronizing controller of FIGS. 16 and 17.

Referring now to the flow chart of FIG. 19, following START the controller initially turns "off" all relays, that is, the relay in each of the ZONE circuits, and also turns "OFF" the "expansion output pulse" to MOSFET Q6. Following a short delay of about 1 second, a counter is started which counts for about 2 seconds after which Pin 12 is read to determine whether it is at +5 volts, indicating no expansion input, or zero in case there is an input. If the answer is "No" the count of the counter is checked to ascertain whether the 2 seconds has elapsed and, if not, pin 12 is again read. A "Yes" decision from either diamond turns "ON" the expansion output pulse to MOSFET Q6 to pass a signal on to the next controller. Then, the four zone inputs (Pins 6, 7, 8 and 9) are scanned to determine which is "ON" or energized; it will be recalled that at least one must be on, otherwise there will be no operating power for the controller. When the "ON" zone or zones have been identified, a relay output signal is applied to and turns on the corresponding zone relays and thereby interrupt power to the associated loop-connected strobes for a short period, in the range from 10 to 30 milliseconds, following which the cycle is repeated.

Figure 21:
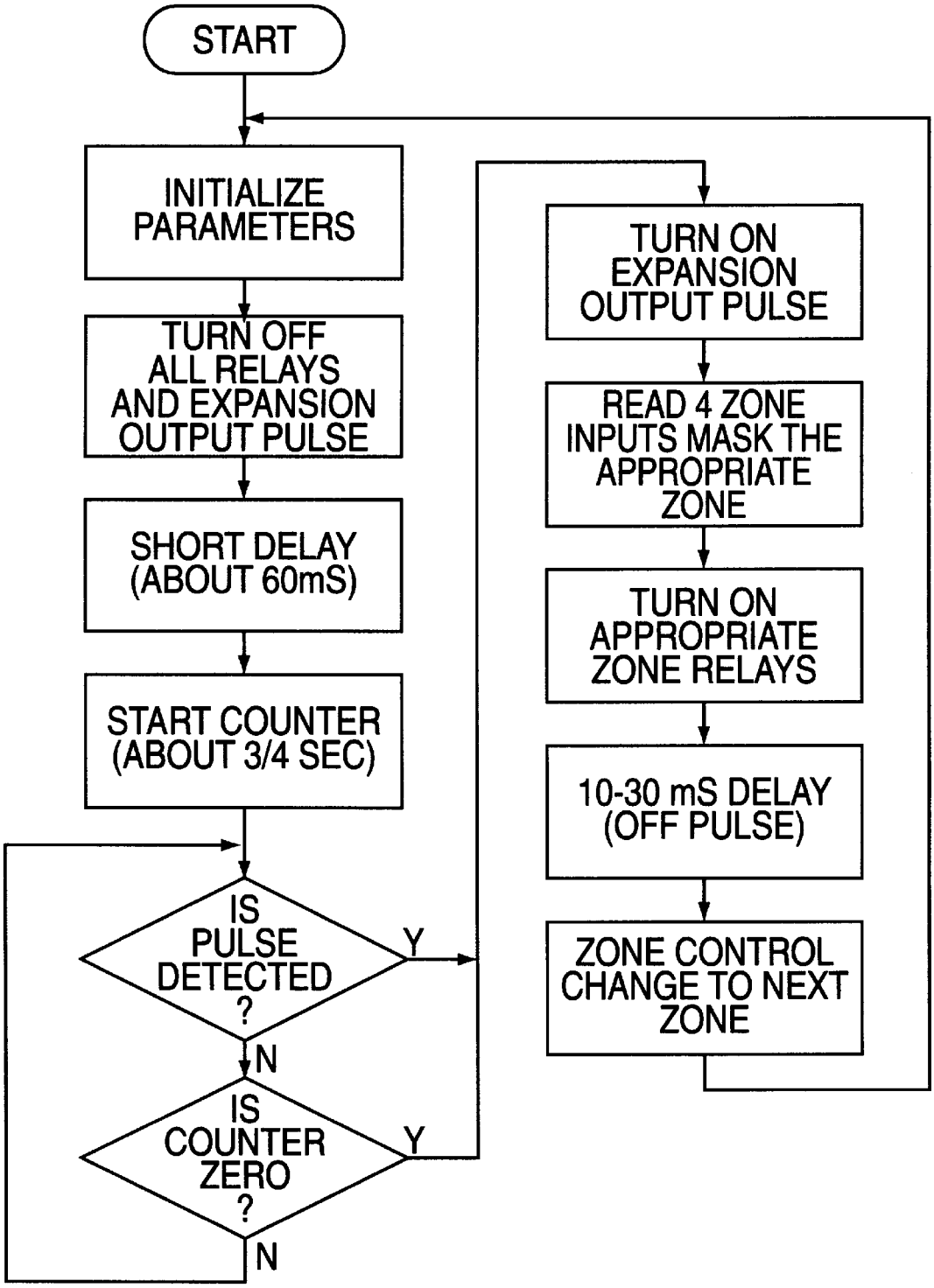
FIG. 21 is a simplified flow chart of alternative functions of the strobe synchronizing controller of FIGS. 16 and 17.

As noted earlier, to preclude the creation of possible anomalies in current flow that might result should all of the strobes in all of the loops be flashing at the same time, the microcontroller may be programmed to interrupt the power supplied to the loops at staggered times within the 2.9 seconds interval. Referring to the simplified flow chart of FIG. 21 which outlines the program, following START the controller initializes parameters and then turns "off" all relays, namely, the relay in each of the ZONE circuits, and also turns "OFF" the "expansion output pulse" to switch Q6. Following a short delay of about 60 milliseconds, a counter is started which counts for about ¾ second after which Pin 12 is read to determine whether it is at 5 volts indicating no expansion pulse input, or zero in case there is an input. If the answer is "No" the count is checked to ascertain whether the ¾ second has elapsed and if not, Pin 12 is again read. A "Yes" decision from either diamond turns on the expansion output pulse to switch Q6 to pass a sync signal to the next controller. Then a first of the four zone inputs (e.g., Pin 6) is scanned to determine if it is "ON" and if energized, a relay output signal is applied to and turns on that zone relay and thereby interrupts power to the associated strobes for a period in the range from 10 to 30 milliseconds. Next the microcontroller repeats the process successively scanning the remaining three zone inputs and applying relay output signals to appropriate zone relays. The net result is that the energized flash units in the four zones are triggered sequentially at ¾ second intervals within a period of about 3 seconds.

While the invention has been described herein by reference to preferred embodiments thereof, it will be understood that such embodiments are susceptible of variation and modification without departing from the inventive concepts disclosed. For example, in the appended claims, the means for performing the different functions may be only a single microprocessor within an alarm unit or the interface control circuit, as described above, or several microprocessors or functional circuits may be employed. All such variations and modifications, therefore, are intended to be included within the spirit and scope of the appended claims.

I claim:

1. A method for synchronizing a plurality of alarm units, said method comprising the steps of:

a) sending a synchronization signal to the plurality of alarm units; and b) triggering the plurality of alarm units in accordance with said received synchronization signal.

2. The method of claim 1, wherein said sending step (a) comprises the step of sending a synchronization signal by interrupting a supply of power to the alarm units.

3. The method of claim 1, wherein said sending step (a) comprises the step of sending a synchronization signal by reversing a polarity of a supply of power to the alarm units.

4. The method of claim 1, further comprising the step of:

c) resetting an internal timer of each of the plurality of alarm units in accordance with said received synchronization signal.

5. The method of claim 4, further comprising the step of:

d) activating each of the plurality alarm units independently if said synchronization signal is not received by each of the plurality of alarm units.

6. The method of claim 1, wherein said plurality of alarm units are organized into a plurality of zones, and wherein said sending step (a) comprises the step of selectively sending a synchronization signal to one or more of said zones.

7. The method of claim 6, wherein said sending step (a) comprises the step of selectively sending a synchronization signal to one or more of said zones in staggered intervals.

8. The method of claim 1, wherein said sending step (a) comprises the step of sending a synchronization and control signal to a plurality of alarm units, wherein said alarm units comprise at least one audible alarm unit and at least one visual alarm unit.

9. The method of claim 8, wherein said sending step (a) comprises the step of sending a synchronization and control signal by interrupting a supply of power to the alarm units.

10. The method of claim 8, wherein said sending step (a) comprises the step of sending a synchronization and control signal by reversing a polarity of said supply of power to the alarm units.

11. The method of claim 8, further comprising the step of:

c) resetting an internal timer of each of the plurality of alarm units in accordance with said received synchronization and control signal.

12. The method of claim 1, further comprising the step of:

d) activating each of the plurality alarm unit independently if said synchronization and control signal is not received by each of the plurality of alarm units.

13. The method of claim 8, wherein said sending step (a) comprises the step of sending a synchronization and control signal having at least one pulse.

14. The method of claim 13, wherein said sending step (a) comprises the step of sending said at least one pulse in a pattern for controlling the at least one audible alarm unit.

15. The method of claim 14, wherein said pattern controls a selection of an audio alarm pattern to be sounded.

16. The method of claim 15, wherein said pattern controls the selection of a Code 3 pattern to be sounded.

17. The method of claim 14, wherein said pattern controls a silence feature of the at least one audible alarm unit.

18. The method of claim 13, wherein said sending step (a) comprises the step of sending said at least one pulse in a pattern for controlling the at least one visual alarm unit.

19. The method of claim 18, wherein said pattern controls a flash rate of the at least one visual alarm unit.

20. The method of claim 8, further comprising the steps of:

(c) detecting a low input voltage condition; and (d) selectively skipping said triggering step (b) when a low input voltage condition is detected in spite of receiving a synchronization and control signal.

21. A method of operating an alarm unit, said method comprising the steps of:

a) receiving a synchronization signal from a synchronization control circuit; and b) activating a visual signaling element of the alarm unit in accordance with said received synchronization signal.

22. The method of claim 21, wherein said activating visual signaling element step (b) comprises the step of activating a flashtube of the alarm unit in accordance with said received synchronization signal.

23. The method of claim 21, further comprising the step of:

c) resetting an internal timer of the alarm unit in accordance with said received synchronization signal.

24. The method of claim 23, further comprising the step of:

d) activating the alarm unit independently if said synchronization signal is not received.

25. The method of claim 21, wherein said receiving step (a) comprises the step of receiving a synchronization and control signal from a synchronization control circuit, and said activating step (b) comprises the step of activating an audible element of the alarm unit in accordance with said received synchronization and control signal.

26. The method of claim 25, further comprising the step of:

c) activating a visual signaling element of the alarm unit in accordance with said received synchronization and control signal.

27. The method of claim 26, further comprising the steps of:

(d) detecting a low input voltage condition; and (e) selectively skipping said activating step (c) when a low input voltage condition is detected in spite of receiving a synchronization and control signal.

28. The method of claim 25, further comprising the step of:

c) resetting an internal timer of the alarm unit in accordance with said received synchronization and control signal.

29. The method of claim 28, further comprising the step of:

d) activating the alarm unit independently if said synchronization signal is not received.

30. A method of operating a synchronization unit to send a synchronization signal to a plurality of alarm units, said method comprising the steps of:

a) providing the plurality of alarm units with a direct connection to a power source during a supervision condition; and b) sending a synchronization signal from the synchronization unit to the plurality of alarm units during an alarm condition.

31. The method of claim 30, wherein said providing step (a) comprises the step of providing the plurality of alarm units with a direct connection to a power source via input terminals and output terminals.

32. The method of claim 30, wherein said sending step (b) comprises the step of sending a synchronization signal by interrupting a supply of power to the alarm units.

33. The method of claim 30, wherein said sending step (b) comprises the step of sending a synchronization signal by reversing a polarity of a supply of power to the alarm units.

34. The method of claim 30, wherein said providing step (a) provides a plurality of visual and audible alarm units with a direct connection to a power source during a supervision condition, and wherein said sending step b) sends a synchronization and control signal from the synchronization unit to the plurality of visual and audible alarm units during an alarm condition.

35. The method of claim 34, wherein said providing step (a) comprises the step of providing the plurality of alarm units with a direct connection to a power source via input terminals and output terminals.

36. The method of claim 34, wherein said sending step (b) comprises the step of sending a synchronization and control signal by interrupting a supply of power to the alarm units.

37. The method of claim 34, wherein said sending step (b) comprises the step of sending a synchronization and control signal by reversing a polarity of a supply of power to the alarm units.

38. An alarm system comprising:

a first synchronization control circuit for sending a synchronization signal to a plurality of alarm units; and a plurality of alarm units for receiving said first synchronization signal to indicate an alarm condition, wherein said plurality of alarm units are activated in accordance with said received synchronization signal.

39. The alarm system of claim 38, wherein said first synchronization control circuit and said plurality of alarm units are arranged in a two-wire loop.

40. The alarm system of claim 39, wherein said plurality of alarm units are organized into a plurality of zones, and wherein said first synchronization control circuit and each of said zones of the alarm units are arranged in a two-wire loop.

41. The alarm system of claim 40, further comprising a second synchronization control circuit, coupled to said first synchronization control circuit, for handling additional plurality of zones of alarm units.

42. The alarm system of claim 41, wherein said first synchronization control circuit and said second synchronization control circuit are connected in a daisy-chain fashion.

43. The alarm system of claim 38, wherein said synchronization signal is a synchronization and control signal, and wherein said plurality of alarm units comprise at least one visual alarm unit and at least one audible alarm unit, and wherein said plurality of visual and audible alarm units are activated in accordance with said received synchronization and control signal.

44. The alarm system of claim 43, wherein said first synchronization control circuit and said plurality of visual and audible alarm units are arranged in a two-wire loop.

45. The alarm system of claim 44, wherein said plurality of visual and audible alarm units are organized into a plurality of zones, and wherein said first synchronization control circuit and each of said zones of the alarm units are arranged in a two-wire loop.

46. The alarm system of claim 43, further comprising a second synchronization control circuit, coupled to said first synchronization control circuit, for handling additional plurality of zones of alarm units.

47. The alarm system of claim 46, wherein said first synchronization control circuit and said second synchronization control circuit are connected in a daisy-chain fashion.

48. The alarm system of claim 43, wherein said synchronization control circuit generates a synchronization and control signal comprising at least one pulse.

49. The alarm system of claim 43, wherein said at least one pulse is in a pattern for controlling the audible alarm unit.

50. The alarm system of claim 43, wherein said at least one pulse is in a pattern for controlling the visual alarm unit.

51. A synchronization control circuit comprising:

first input terminals;

output terminals;

a switch, coupled between said first input terminals and said output terminals, for passing a supply voltage to a plurality of alarm units; and a controller, coupled to said switch, for detecting an alarm condition, where upon detection of said alarm condition, said controller controls said switch to generate a synchronization signal for said plurality of alarm units.

52. The synchronization control circuit of claim 51, wherein said switch is a relay.

53. The synchronization control circuit of claim 51, wherein said synchronization signal is an interruption of said supply voltage to said plurality of alarm units.

54. The synchronization control circuit of claim 51, wherein said synchronization signal is generated by reversing a polarity of said supply of power to the alarm units.

55. The synchronization control circuit of claim 51, further comprising:

an expansion circuit, coupled to said controller, for communicating with a second synchronization control circuit.

56. The synchronization control circuit of claim 55, wherein said expansion circuit comprises expansion input and output terminals for passing said synchronization signal to said second synchronization control circuit.

57. The synchronization control circuit of claim 51, wherein said controller controls said switch to generate a synchronization and control signal for said plurality of alarm units, wherein said plurality of alarm units comprise at least one visual alarm unit and one audible alarm unit.

58. The synchronization control circuit of claim 57, wherein said synchronization and control signal is an interruption of said supply voltage to said plurality of visual and audible alarm units.

59. The synchronization control circuit of claim 57, wherein said synchronization and control signal is generated by reversing a polarity of a supply of power to the visual and audible alarm units.

60. The synchronization control circuit of claim 57, wherein said synchronization and control signal comprises at least one pulse.

61. The synchronization control circuit of claim 60, wherein said at least one pulse is a pattern for controlling said at least one audible alarm unit.

62. The synchronization control circuit of claim 60, wherein said at least one pulse is a pattern for controlling said at least one visual alarm unit.

63. The synchronization control circuit of claim 57, further comprising:

second input terminals, coupled to said controller, for receiving a control signal from a fire alarm control panel.

64. An alarm unit comprising:

a signaling device; and a controller, coupled to said signaling device, for detecting a synchronization signal to activate said signaling device.

65. The alarm unit of claim 64, wherein said controller comprises a synchronization trigger circuit.

66. The alarm unit of claim 64, wherein said controller comprises a microcontroller.

67. The alarm unit of claim 64, wherein said signaling device is a visual indicator.

68. The alarm unit of claim 64, wherein said signaling device is an audible indicator.

69. The alarm unit of claim 64, further comprising a timer trigger circuit, coupled to said signaling device, for activating said signaling device if said synchronization signal is not received in a predetermined time interval.

70. The alarm unit of claim 64, wherein controller is for detecting a synchronization and control signal to activate said signaling element.

71. The alarm unit of claim 70, wherein said controller detects said synchronization and control signal comprising at least one pulse in a pattern, wherein said controller uses said pattern to silence said signaling device.

72. The alarm unit of claim 70, wherein said controller is for controlling an activation rate of said signaling element.

73. The alarm unit of claim 72, wherein said controller selectively alters said activation of said signaling element when a low input voltage condition is detected.

* * * * *

UNITED STATES PATENT AND TRADEMARK OFFICE

CERTIFICATE OF CORRECTION

PATENT NO. : 5,982,275
APPLICATION NO. : 09/074328
DATED : November 9, 1999
INVENTOR(S) : Joseph Kosich et al.

It is certified that error appears in the above-identified patent and that said Letters Patent is hereby corrected as shown below:

Title Page, item [75]
Inventor: Please Insert - Applegate, Edward V., Toms River, N.J.

Signed and Sealed this

Twenty-second Day of August, 2006

JON W. DUDAS
*Director of the United States Patent and Trademark Office*